US007057558B2

(12) United States Patent
Fukushima et al.

(10) Patent No.: US 7,057,558 B2
(45) Date of Patent: Jun. 6, 2006

(54) ANTENNA DEVICE

(75) Inventors: Susumu Fukushima, Osaka (JP); Takeo Yasuho, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/490,373

(22) PCT Filed: Jun. 26, 2003

(86) PCT No.: PCT/JP03/08089

§ 371 (c)(1),
(2), (4) Date: Mar. 23, 2004

(87) PCT Pub. No.: WO2004/004068

PCT Pub. Date: Jan. 8, 2004

(65) Prior Publication Data

US 2004/0246181 A1 Dec. 9, 2004

(30) Foreign Application Priority Data

Jun. 27, 2002 (JP) ..... 2002-187221

(51) Int. Cl.
*H01Q 1/38* (2006.01)
*H01Q 21/00* (2006.01)

(52) U.S. Cl. ..... 343/700 MS; 343/725

(58) Field of Classification Search ..... 343/700 MS, 343/846, 860, 895, 725
See application file for complete search history.

(56) References Cited

U.S. PATENT DOCUMENTS 4,827,266 A 5/1989 Sato et al.
5,216,430 A * 6/1993 Rahm et al. ..... 343/700 MS
6,061,025 A * 5/2000 Jackson et al. ..... 343/700 MS
6,295,030 B1 9/2001 Kozakai et al.
6,809,686 B1 * 10/2004 Du et al. ..... 343/700 MS
6,812,902 B1 * 11/2004 Rossman et al. ..... 343/725
2002/0000938 A1 1/2002 Hoashi et al.

FOREIGN PATENT DOCUMENTS

| | | |
|---|---|---|
| JP | 56-141604 | 11/1981 |
| JP | 61-7706 | 1/1986 |
| JP | 62-39317 | 3/1987 |
| JP | 2-246502 | 10/1990 |
| JP | 8-195619 | 7/1996 |
| JP | 9-121114 | 5/1997 |
| JP | 9-238020 | 9/1997 |
| JP | 9-284039 | 10/1997 |
| JP | 2001-94338 | 4/2001 |
| JP | 2001-332920 | 11/2001 |

* cited by examiner

OTHER PUBLICATIONS

International Search Report corresponding to application No. PCT/JP03/08089 dated Sep. 2, 2003.

*Primary Examiner*—Shih-Chao Chen
(74) *Attorney, Agent, or Firm*—RatnerPrestia

(57) ABSTRACT

A small antenna has two or more feeding ports. A radiator is made of a planar conductor having a substantially circular shape having the diameter of a substantially half wavelength or a substantially regularly polygonal shape where the length of a diagonal line passes through the center point is the substantially half wavelength. A ground plate is faced to the radiator. On the radiator, the feeding ports are connected to feeding points on two orthogonal line segments passing through the center of the radiator. This antenna is used as not only a single antenna but also two independent antennas having secured isolation between the feeding ports. A small antenna device used as two independent antennas is thus provided. The radiator is formed in a hat shape having an edge, has an Stepped Impedance Resonator (SIR) structure where the diameter of a crest part is a quarter wavelength, and is shortened.

25 Claims, 16 Drawing Sheets

ANTENNA DEVICE

This application is a 371 of PCT/JP03/08089 filed on Jun. 6, 2003.

TECHNICAL FIELD

The present invention relates to an antenna device used mainly for mobile communication and short-range communication by a mobile terminal or the like.

BACKGROUND ART

Conventionally, some antenna device capable of corresponding to a plurality of information communication systems using one frequency is used together with a communication module shown in FIG. 19. In FIG. 19, communication module 100 corresponds to both short-range communication system 103 and Wireless-Local Area Network (W-LAN) system 104. In designing such communication module 100, the following points need to be considered:

two systems 103 and 104 use the same frequency band such as 2.4 GHz band; and these systems are simultaneously used.

In other words, both systems can be simultaneously in a transmitting state or in a receiving state, or one system can be in the transmitting state and the other system can be in the receiving state. In the latter case, a signal from one system works as an interference signal with the other system to significantly increase the bit error rate (BER) of a received signal of the latter system.

For preventing this radio interference, conventionally, a high-frequency filter is directly connected to an antenna to remove signals from the other system. However, two systems 103 and 104 use the same frequency band in communication module 100 in FIG. 19, so that the method of the direct connection cannot be used for rejecting the signals from the other system. In communication module 100, therefore, systems 103 and 104 have respective independent antennas 101 and 102, thereby preventing the radio interference between the systems. An arranging method of two antennas 101 and 102 is thus designed, thereby securing the isolation between the systems.

According to a theoretical calculation in case that two dipole antennas for 2.4 GHz are employed, for example, the interval between both antennas is required to be 320 mm for securing the isolation of 26 dB between the antennas.

Two antennas 101 and 102 are required to be physically separated from each other in the structure discussed above, so that a housing for mounting communication module 100 inevitably increases in size. Further, two positions for mounting the antennas need to be secured in case that two separated antennas 101 and 102 are employed, so that device design is restricted and cost required for the antenna device doubles.

SUMMERY OF THE INVENTION

The present invention provides an antenna device having a single antenna structure in which one antenna has a plurality of feeding ports and isolation can be secured between the ports. The antenna device of the present invention has two or more feeding ports. Each feeding port is disposed in a region where the high-frequency voltage on a radiator generated by feeding from the other feeding port is zero.

Since each feeding port is disposed in such a position, the voltage at each feeding port position, which is generated by a high-frequency signal from the other feeding port, is not varied with time. Thus, the interference of the high-frequency signal from the other feeding port can be reduced.

A conventional antenna device requires two antennas, but the antenna device of the present invention requires only one antenna. Therefore, required space for antenna installation can be reduced in half in the housing of the present antenna device, so that the housing can be downsized and the cost can be reduced.

In an embodiment of the present invention, the antenna device includes:

a radiator made of a planar conductor having one of the following shapes:

- a substantial circle whose diameter is a substantially half wavelength;
- a substantially regular polygon where the length of a diagonal line passing through the center point is a substantially half wavelength; and
- a substantial quadrangle whose edge length is a substantially half wavelength;

a ground plate which is faced to the radiator and is separated from the radiator by a predetermined distance; and feeding ports connected to two feeding points predetermined on the radiator.

Each of these two feeding points on the radiator lies in a range where the high-frequency voltage generated by the feeding from the other feeding port is zero. This structure allows securement of the isolation between the feeding ports.

In an antenna device of another embodiment of the present invention, respective straight lines passing through the center point of the radiator and respective feeding points are set to intersect at right angles, and feeding ports can be disposed inside the periphery. Each feeding port can be thus easily impedance-matched.

In an antenna device of still another embodiment of the present invention, a third feeding port is disposed at the center point of the radiator. A small antenna device having three mutually isolated feeding ports can be realized.

In an antenna device of still another embodiment, the frequencies used for three feeding ports are set substantially equal to each other. The voltage at the center point of the radiator is thus substantially zero, so that the isolation between the third feeding port and the other feeding ports can be kept large.

In an antenna device of still another embodiment, first and second feeding ports are disposed on the outer periphery of the radiator. A conductive plate is press-machined, parts of the conductive plate corresponding to the feeding ports are bent substantially perpendicularly, and these parts can be directly mounted to a land for feeding on a high-frequency substrate forming a ground plate, so that an economical and simple manufacturing method can be employed.

In an antenna device of still another embodiment, a radiator is deformed so that the distance between the radiator and a ground plate is longer in at least a central part of the radiator than in the other parts of the radiator, thereby forming a crest part. Thus, the radiator becomes formed of the crest part and a trough part other than the crest part. The ground plate may be deformed similarly. In this case, the radiator has a Stepped Impedance Resonator (SIR) structure and hence the resonator length can be shortened, so that the antenna device can be downsized.

In an antenna device of still another embodiment, the radiator or the ground plate is formed so that its trough part has an arbitrary width dependent on places and the top surface of its crest part is flat. The area of the top surface of the crest part can be set large, and the antenna device having high radiation efficiency and wide-band capability can be realized.

In an antenna device of still another embodiment, arbitrary number of notches are formed at arbitrary positions in a periphery of the radiator. The electrical length of the radiator can thus be equivalently extended, so that the antenna device can be downsized.

In an antenna device of still another embodiment, the width of the trough part of the radiator or the ground plate is set to be ⅛ wavelength in electrical length. In this case, an SIR structure is employed where the center point of a quarter wavelength resonator is a boundary between the trough part and the crest part, so that the radiator length can be minimized and the antenna device can be further downsized.

In an antenna device of still another embodiment, an electromagnetic medium such as a dielectric material, a magnetic material, or a mixture of dielectric and magnetic materials is disposed between the radiator and the ground plate. In this case, a wavelength shortening effect of the electromagnetic medium allows the antenna device to be downsized.

In an antenna device of still another embodiment, the electromagnetic medium has a multilayered structure, and an impedance-matching circuit is disposed on a surface of at least one layer. Thus, an external matching circuit need not to be connected, so that a mounting area can be reduced and the cost can be reduced.

In an antenna device of still another embodiment, conductive elements having an opened end are disposed at the positions on the radiator that are symmetric to the feeding ports with respect to the center of the radiator. The electrical length of the radiator can thus be equivalently extended, so that the antenna device can be downsized.

In an antenna device of still another embodiment, the opened ends of the conductive elements are cut to change the electrical length, thereby adjusting the isolation between feeding ports. In this case, a characteristic of the antenna device affected by the housing can be adjusted, so that the antenna device can be speedily corresponded to various housings in designing.

In an antenna device of still another embodiment, the conductive element is formed in a meander shape. The conductive element may be connected to a reactance element having a grounded end. An adjusting range of the impedance characteristic of the antenna device can be expanded in the view from each feeding port.

In an antenna device of still another embodiment, the feeding port is formed of a meander-shaped conductive element. In this case, the feeding port is a part of the radiator, so that the electrical length of the radiator can be equivalently extended and the antenna device can be downsized.

In an antenna device of still another embodiment, all conductive elements have the same shape, their reactance values are set at the same value, or all feeding ports have the same shape. The antenna device thus has a symmetric structure, so that the isolation between the feeding ports can be increased.

In an antenna device of still another embodiment, each of a plurality of feeding ports is used as a feeding port of an antenna of a diversity communication system. The number of antennas can be thus reduced from plurality to one, and an inexpensive and small diversity antenna device can be realized.

In an antenna device of still another embodiment, each of two feeding ports is used as a feeding port of an antenna of a first communication system employing diversity system or circular polarization, and the third feeding port is used in a second communication system. Thus, the third feeding port is used for a short-range communication system or Vehicle Information and Communication System (VICS), and the other feeding ports can be used for a polarization-diversity antenna for IEEE 802.11b or Global Positioning System (GPS). A space occupied by the antenna can be saved in a portable terminal, thereby downsizing a communication apparatus.

BRIEF DESCRIPTION OF THE DRAWINGS

FIG. 1 (*b*) is a top view of the antenna device in accordance with exemplary embodiment 1.

FIG. 3 (*b*) is a top view of an antenna device in accordance with exemplary embodiment 3.

FIG. 4 (*b*) is a sectional view of the antenna device in accordance with exemplary embodiment 4.

FIG. 5 (*b*) is a sectional view of the antenna device in accordance with exemplary embodiment 5.

FIG. 6 (*b*) is a perspective view of another antenna device in accordance with exemplary embodiment 6.

FIG. 7 (*b*) is a sectional view of the antenna device in accordance with exemplary embodiment 7.

FIG. 8 (*b*) is a top view of the antenna device in accordance with exemplary embodiment 8.

FIG. 9 (*b*) is a bottom perspective view of the antenna device in accordance with exemplary embodiment 9.

FIG. 10 (*b*) is a bottom view of the antenna device in accordance with exemplary embodiment 9.

FIG. 11 (*b*) is a bottom perspective view of the antenna device in accordance with exemplary embodiment 10.

FIG. 13 (*b*) is a sectional view of the antenna device in accordance with exemplary embodiment 12.

DETAILED DESCRIPTION OF PREFERRED EMBODIMENTS (Exemplary Embodiment 1)

Figure 1A:
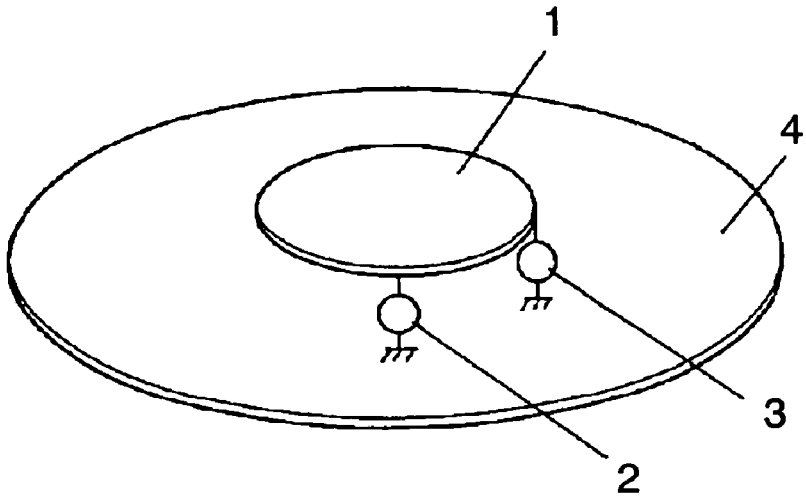
FIG. 1 (*a*) is a perspective view of an antenna device in accordance with exemplary embodiment 1 of the present invention.
Figure 1B:
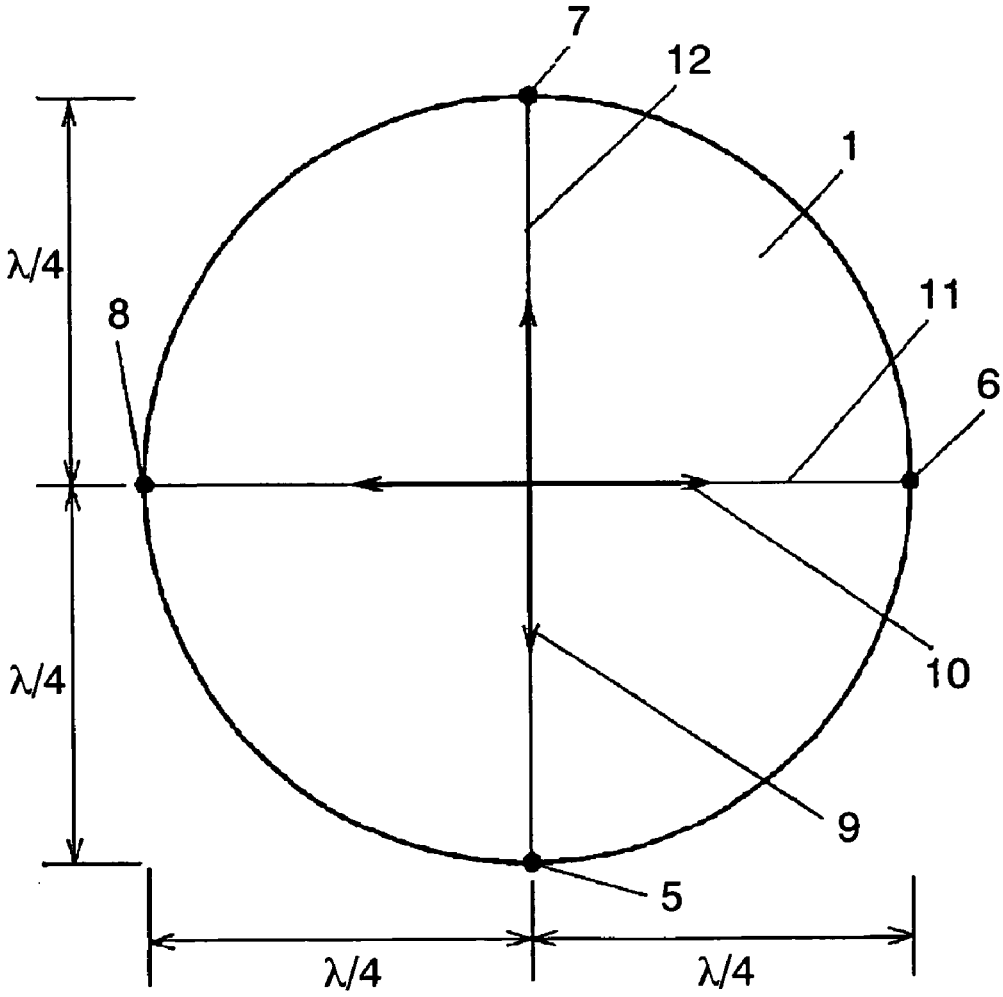

FIG. 1 (*a*) and FIG. 1 (*b*) show an antenna device in accordance with exemplary embodiment 1 of the present invention. As shown in the perspective view of FIG. 1 (*a*), the antenna device includes a plurality of feeding ports 2 and 3 disposed on the peripheral part of radiating plate 1 faced to ground plate 4. The shape of radiating plate 1 is a circle whose diameter is a half wavelength in electrical length at a predetermined frequency as shown in FIG. 1 (*b*), first feeding port 2 is disposed at one of feeding points 5 and 7, and second feeding port 3 is disposed at one of feeding points 6 and 8.

In FIG. 1 (*a*) and FIG. 1 (*b*), first feeding port 2 is connected to feeding point 5. When a signal with a predetermined frequency comes through feeding port 2, radiating plate 1 and ground plate 4 operate as a half wavelength resonator with both ends opened extending from feeding point 5 to feeding point 7, first resonance current 9 flows on radiating plate 1, and the high-frequency voltage becomes zero at the center point of the resonator. The center point lies at a position quarter wavelength away from feeding point 5. In other words, voltage becomes zero on first line segment 11 on radiating plate 1. While, feeding points 6 and 8 exist on first line segment 11 where the high-frequency voltage is zero, so that the high-frequency signal of the predetermined frequency coming through feeding port 2 does not leak into second feeding port 3.

When second feeding port 3 is connected to feeding point 6 and a signal of a predetermined frequency comes through feeding port 3, radiating plate 1 and ground plate 4 operate as a half wavelength resonator with both ends opened extending from feeding point 6 to feeding point 8, second resonance current 10 flows on radiating plate 1, and the high-frequency voltage becomes zero at the center point of the resonator. The center point lies at a position quarter wavelength away from feeding point 6. In other words, voltage becomes zero on second line segment 12 on radiating plate 1. On the other hand, feeding points 5 and 7 exist on second line segment 12 where the high-frequency voltage is zero, so that the high-frequency signal of the predetermined frequency coming through second feeding port 3 does not leak into first feeding port 2.

For realizing the characteristics discussed above, the line segment between feeding points 5 and 7 and the line segment between feeding points 6 and 8 are positioned so as to intersect at the center of radiating plate 1 at right angles.

Employing such an antenna device allows reduction of the number of required antennas from two to one, cost reduction of the antenna device, and downsizing of the communication equipment.

Radiating plate 1 is circular in this embodiment. However, the radiating plate may be substantially circular.

(Exemplary Embodiment 2)

Figure 2:
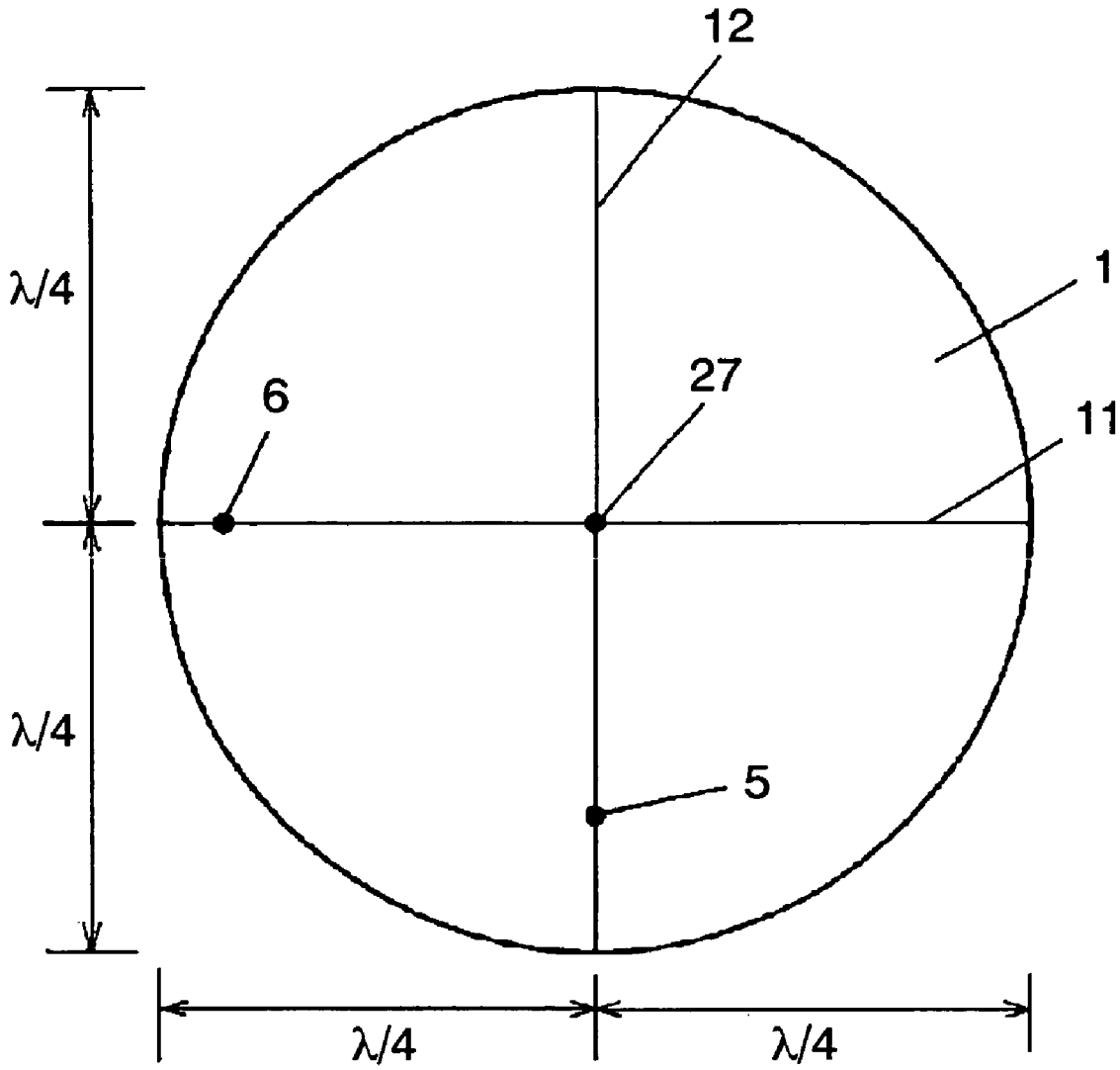
FIG. 2 is a top view of an antenna device in accordance with exemplary embodiment 2 of the present invention.

FIG. 2 shows an antenna device in accordance with exemplary embodiment 2 of the present invention. Feeding points of the previous embodiment are disposed on the outer periphery of radiating plate 1 in the antenna device shown in FIG. 1 (*b*). However, feeding points of this embodiment are disposed at positions having a suitable distance inwardly away from the outer periphery of radiating plate 1 in the antenna device shown in FIG. 2. The structure of FIG. 2 produces an effect of facilitating impedance-matching at each feeding point. The feeding points are disposed on first line segment 11 and second line segment 12 where the high-frequency voltage is zero, and then secure the isolation between the feeding ports.

Feeding point 27 is disposed at the center point of radiating plate 1, and a third feeding port is joined to feeding point 27. Respective signals of a predetermined frequency coming into radiating plate 1 through feeding points 5 and 6 connected respectively to first and second feeding ports do not leak into the third feeding port connected to feeding point 27 at the center point of radiating plate 1. However, a signal of a predetermined frequency coming into radiating plate 1 through the third feeding port leaks into the first and second feeding ports through respective feeding points 5 and 6, so that the third feeding port can be used as not a transmitting port but only a receiving port. Disposing the third feeding port at the center point of radiating plate 1 increases an application range of the antenna device of the present embodiment.

Frequencies used for the three feeding ports may be set substantially the same. At this time, the voltage at the center point of radiator is substantially zero. The isolation between the third feeding port and the other feeding ports can be sufficiently secured.

(Exemplary Embodiment 3)

Figure 3A:
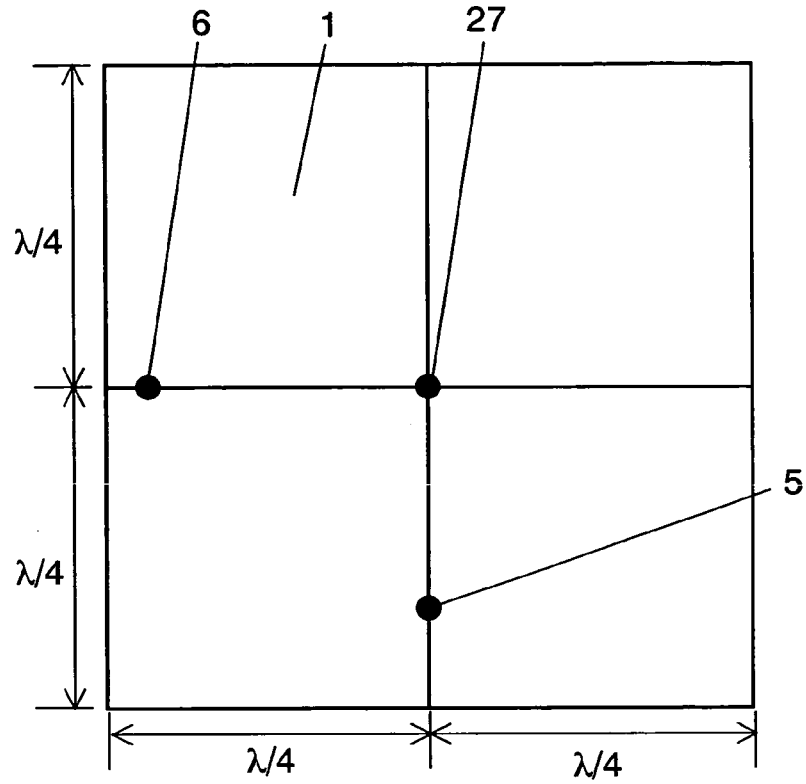
FIG. 3 (*a*) is a top view of an antenna device in accordance with exemplary embodiment 3 and exemplary embodiment 13 of the present invention.
Figure 3B:
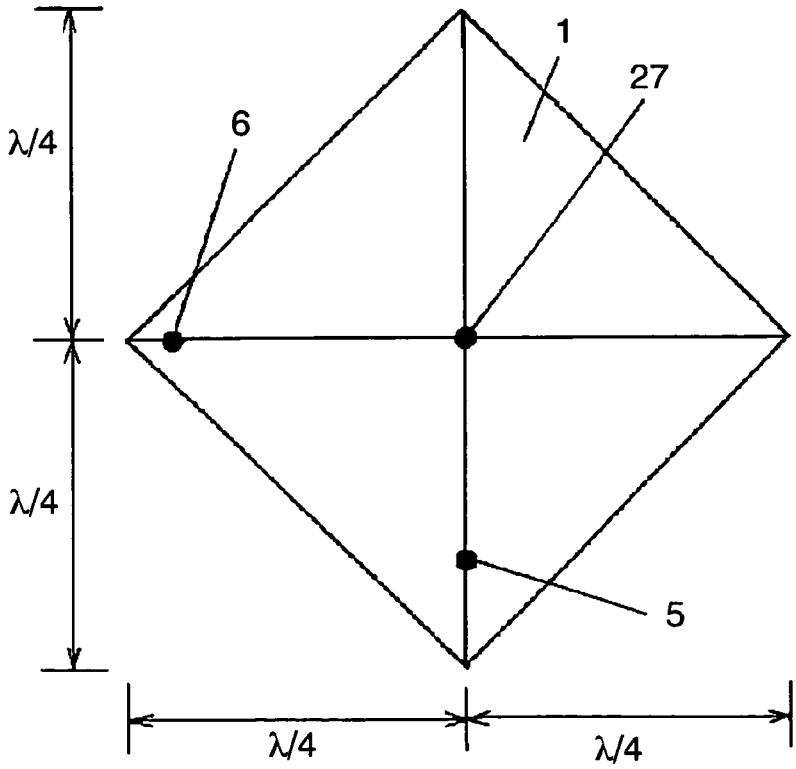

FIG. 3 (*a*) and FIG. 3 (*b*) show antenna devices in accordance with exemplary embodiment 3 of the present invention. Radiating plate 1 of embodiment 3 is square. FIG. 3 (*a*) shows the case that the edge length of radiating plate 1 is a half wavelength and respective feeding points 5 and 6 connected to the first and second feeding ports are disposed on the line segments that pass through the center point of the square and are parallel with the edges. FIG. 3 (*b*) shows the case that the diagonal length of radiating plate 1 is a half wavelength and respective feeding points 5 and 6 connected to the first and second feeding ports are disposed on the diagonal lines of the square. In either of these cases, the third feeding port is connected to feeding point 27 at the center point of radiating plate 1. The antenna devices of the present embodiment produce an advantage similar to that of the antenna device of embodiment 2 where radiating plate 1 is circular.

Radiating plates 1 are circular or square in embodiments 1 to 3. However, radiating plate 1 may be substantially circular, substantially square, or substantially regularly polygonal.

(Exemplary Embodiment 4)

Figure 4A:
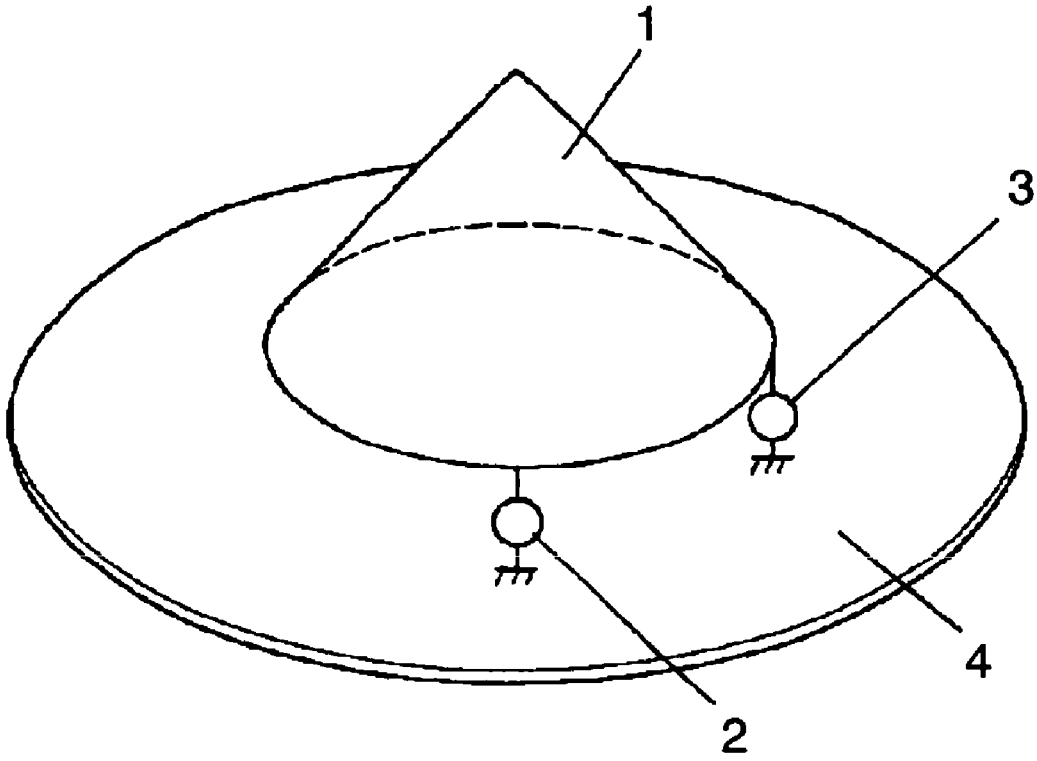
FIG. 4 (*a*) is a perspective view of an antenna device in accordance with exemplary embodiment 4 of the present invention.
Figure 4B:
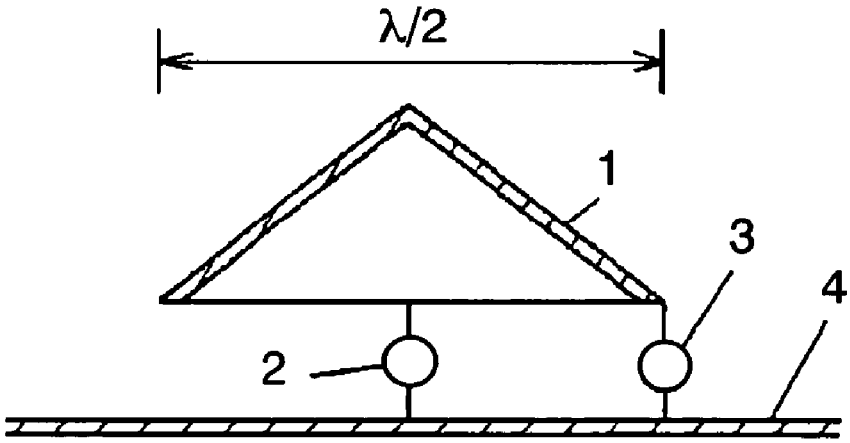

FIG. 4 (*a*) and FIG. 4 (*b*) show an antenna device in accordance with exemplary embodiment 4 of the present invention.

In the antenna device of the present embodiment, radiator 1 has a hat shape having no edge, the main part of the hat shape, namely the crest part, is conical, and radiator 1 is erected away from ground plate 4 by a predetermined distance, as shown in FIG. 4 (*a*) and FIG. 4 (*b*). The diameter of the bottom of the conical shape is a half wavelength in electrical length at a predetermined frequency, and a position on the bottom corresponding to the apex of the crest part is separated from the outer periphery by a quarter wavelength in electrical length. The distance between ground plate 4 and radiating plate 1 is the longest at the apex and the shortest on the outer periphery. First and second feeding ports 2 and 3 are disposed on the outer periphery of radiator 1, similarly to the case of embodiment 1 shown in FIG. 1 (*b*).

Generally, it is well known to skilled persons that the length of the latter kind of resonator of the following two kinds of quarter wavelength resonators with an opened end can be further shortened:

a resonator in which the interval between a signal line and the ground is constant and characteristic impedance is not changed over the resonator; and a resonator in which the interval between a signal line and the ground is not constant and characteristic impedance is increased toward the opened end. The antenna device of the present embodiment employs this property of the quarter wavelength resonator. In other words, as shown in the sectional view of FIG. 4 (*b*), it can be considered that the apex of conical radiating plate 1 is the opened end of the quarter wavelength resonator, and is the farthest point from ground 4. Therefore, the device has the highest characteristic impedance at the apex. Here, the opened end is an end not connected to the feeding port.

The outer periphery connected to the feeding ports is the closest to ground plate 4, therefore the device has the lowest characteristic impedance at the outer periphery.

Forming radiating plate 1 into a conical shape allows reduction of the diameter of the bottom of radiator 1 and downsizing of the antenna device.

(Exemplary Embodiment 5)

Figure 5A:
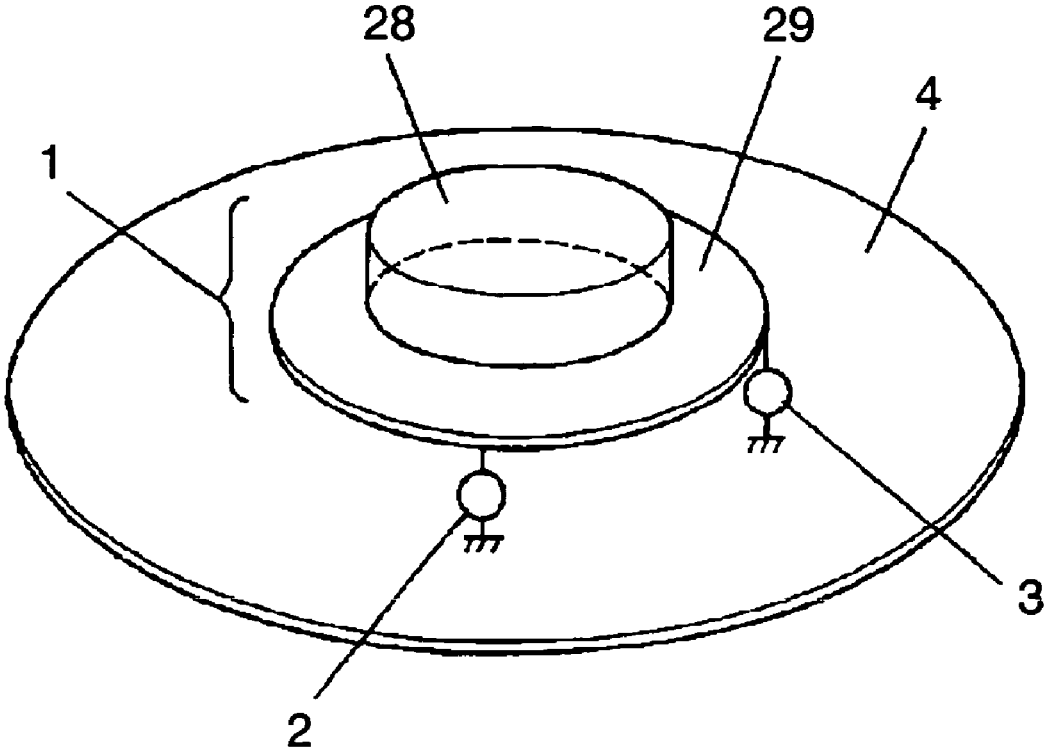
FIG. 5 (*a*) is a perspective view of an antenna device in accordance with exemplary embodiment 5 of the present invention.
Figure 5B:
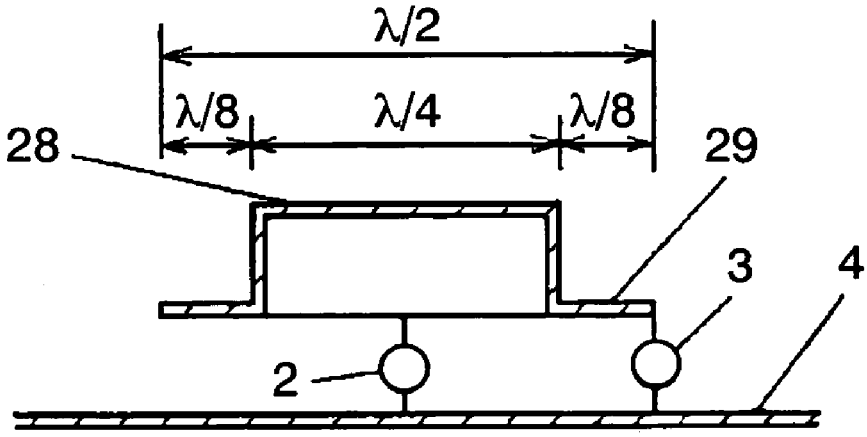

FIG. 5 (*a*) and FIG. 5 (*b*) show an antenna device in accordance with exemplary embodiment 5 of the present invention.

In the antenna device of the present embodiment, radiator 1 has a hat shape having an edge, the diameter of trough part 29 of the hat shape is a half wavelength in electrical length at a predetermined frequency. The width of trough part 29 is ⅛ wavelength in electrical length at the predetermined frequency. In crest part 28 of the hat shape, the diameter of the top surface is a quarter wavelength, and the side surface is vertically connected to trough part 29, as shown in FIG. 5 (*a*) and FIG. 5 (*b*). In radiator 1 having this structure, the interval between trough part 29 and ground plate 4 is shorter than that between crest part 28 and ground plate 4.

In the present embodiment, similarly to embodiment 4, the characteristic impedance is increased in step-wise manner at a position which is an appropriate distance inwardly away from the outer periphery of trough part 29 of radiator 1, thereby shortening the length of the quarter wavelength resonator. Therefore, the antenna device can be downsized. Additionally, the top surface of the crest part is expanded, thereby realizing high radiation efficiency and wide-band capability. The case that the characteristic impedance is changed at a position which is ⅛ wavelength inwardly away from the outer periphery of trough part 29 produces the greatest advantage.

When the center point of radiator 1 is defined to be the center of the outline shape of trough part 29, respective line segments connecting the center point of radiator 1 to respective feeding ports 2 and 3 intersect in right angles, and first and second feeding ports 2 and 3 are disposed on the respective line segments.

(Exemplary Embodiment 6)

Figure 6A:
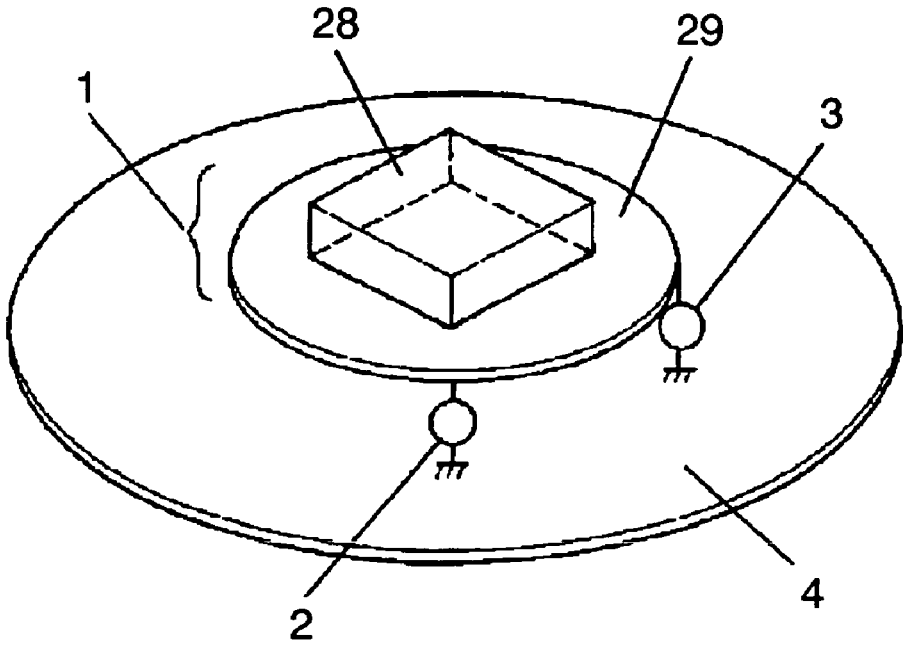
FIG. 6 (*a*) is a perspective view of an antenna device in accordance with exemplary embodiment 6 of the present invention.
Figure 6B:
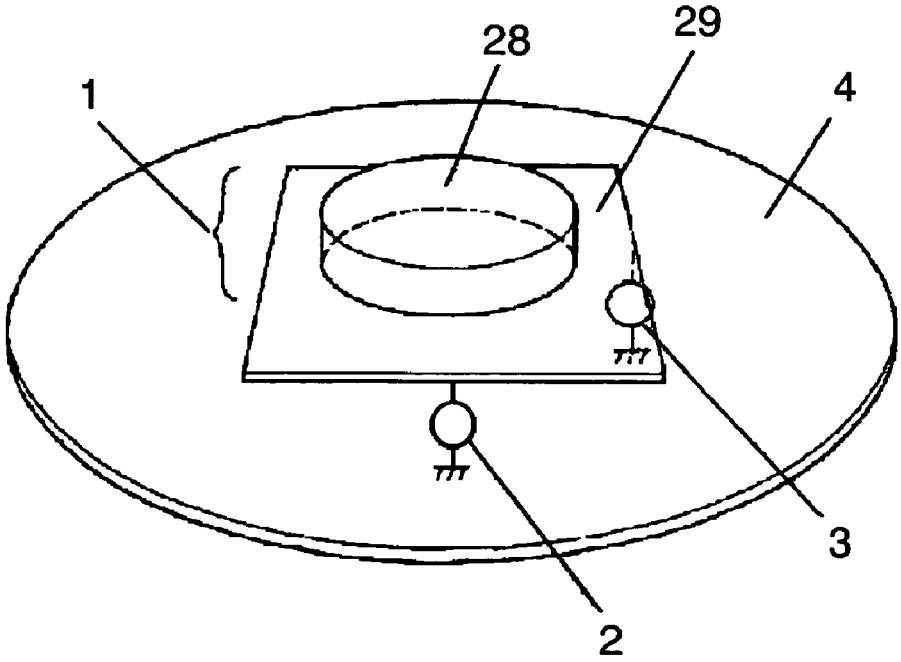

FIG. 6 (*a*) and FIG. 6 (*b*) show antenna devices in accordance with exemplary embodiment 6 of the present invention. FIG. 6 (*a*) shows an antenna device where the outline of trough part 29 of radiator 1 is a circle and the outline of crest part 28 is a regular quadrangle. FIG. 6 (*b*) shows another antenna device where the outline of trough part 29 of radiator 1 is a regular quadrangle and the outline of crest part 28 is a circle. In either of the antenna devices, the interval between ground plate 4 and the top surface of crest part 28 is longer than that between ground plate 4 and trough part 29. When the center point of radiator 1 is defined to be the center of the outline shape of trough part 29, the straight line passing through first feeding port 2 and the center point of radiator 1 becomes a symmetry axis of radiator 1, in FIG. 6 (*a*) and FIG. 6 (*b*).

The straight line passing through second feeding port 3 and the center point of radiator 1 also becomes a symmetry axis of radiator 1. This structure can secure the isolation between feeding ports 2 and 3, and produces an advantage similar to that in the antenna device of embodiment 5.

(Exemplary Embodiment 7)

Figure 7A:
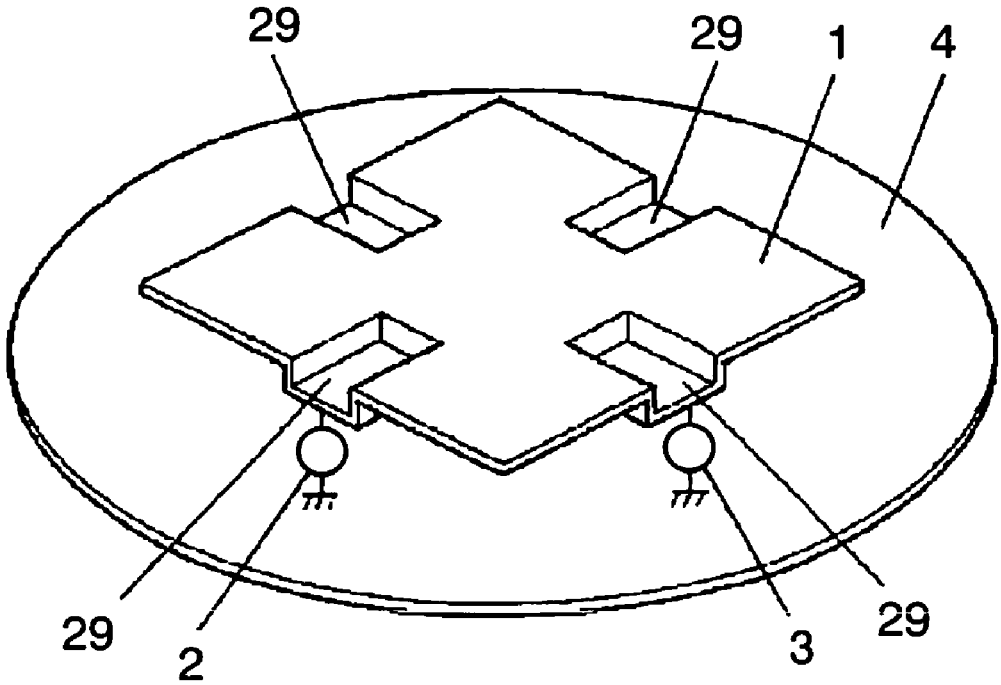
FIG. 7 (*a*) is a perspective view of an antenna device in accordance with exemplary embodiment 7 of the present invention.
Figure 7B:
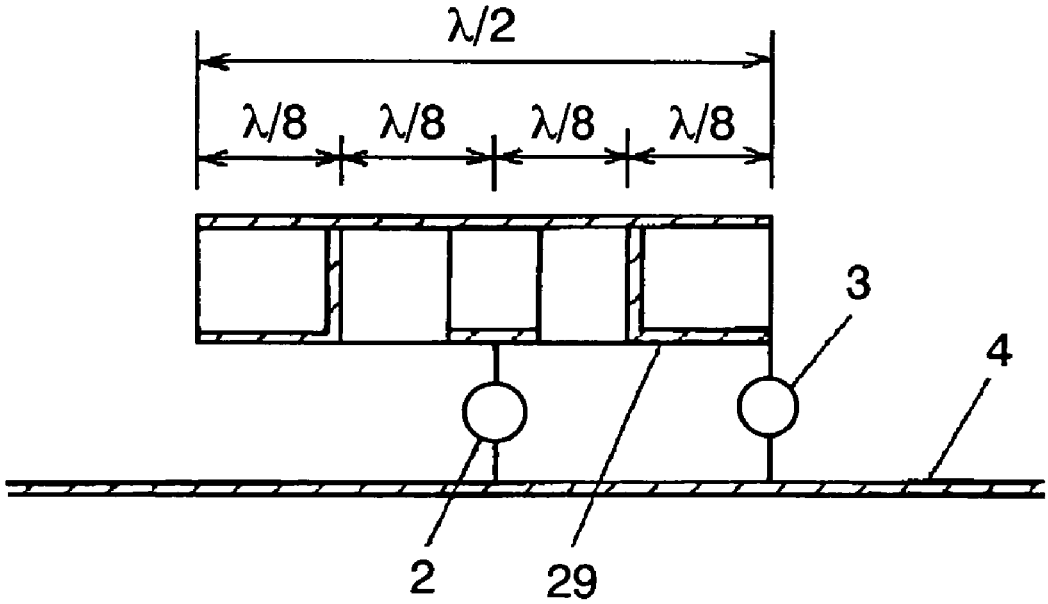

FIG. 7 (*a*) and FIG. 7 (*b*) show an antenna device in accordance with exemplary embodiment 7 of the present invention. In the antenna device of the present embodiment, steps are partially formed in the periphery of regularly quadrangular radiator 1 to form trough parts 29 as shown in FIG. 7 (*a*). The part other than trough parts 29 in radiator 1 forms crest part 1. The interval between trough part 29 and ground plate 4 is short, and the interval between crest part 1 and ground plate 4 is long, as shown in FIG. 7 (*a*) and FIG. 7 (*b*). When first and second feeding ports 2 and 3 are disposed each other at point-symmetry positions with respect to the center point of radiator 1 on the outer periphery of trough parts 29, it can be considered that this radiator is formed by deforming the hat-shaped radiator of embodiment 5. In embodiment 7, the area of the top surface of the crest part of radiator 1 can be set large, so that an antenna device having high radiation efficiency and wide-band capability can be realized.

(Exemplary Embodiment 8)

Figure 8A:
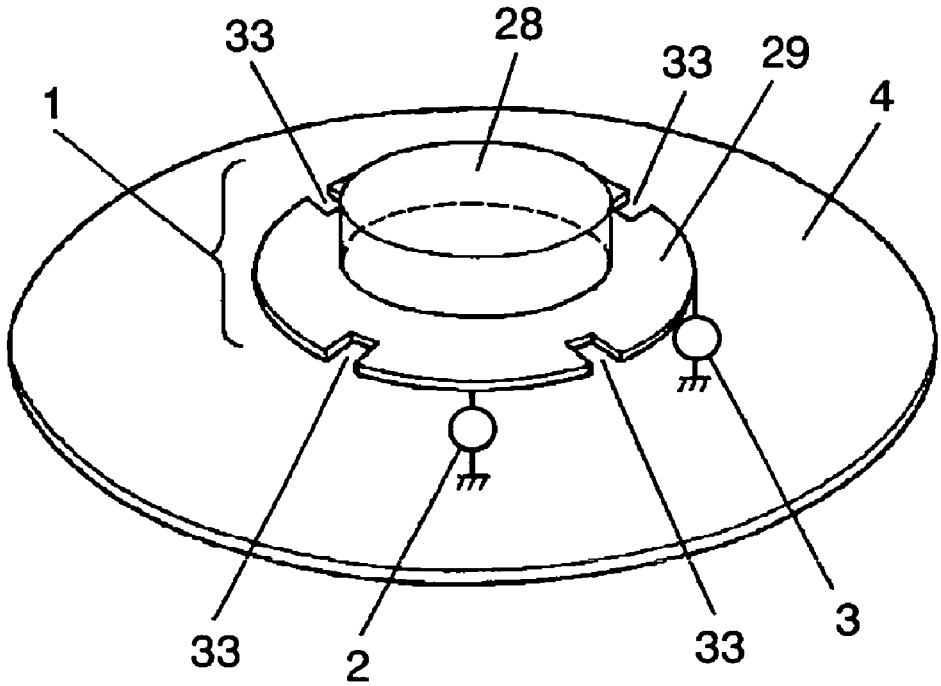
FIG. 8 (*a*) is a perspective view of an antenna device in accordance with exemplary embodiment 8 of the present invention.
Figure 8B:
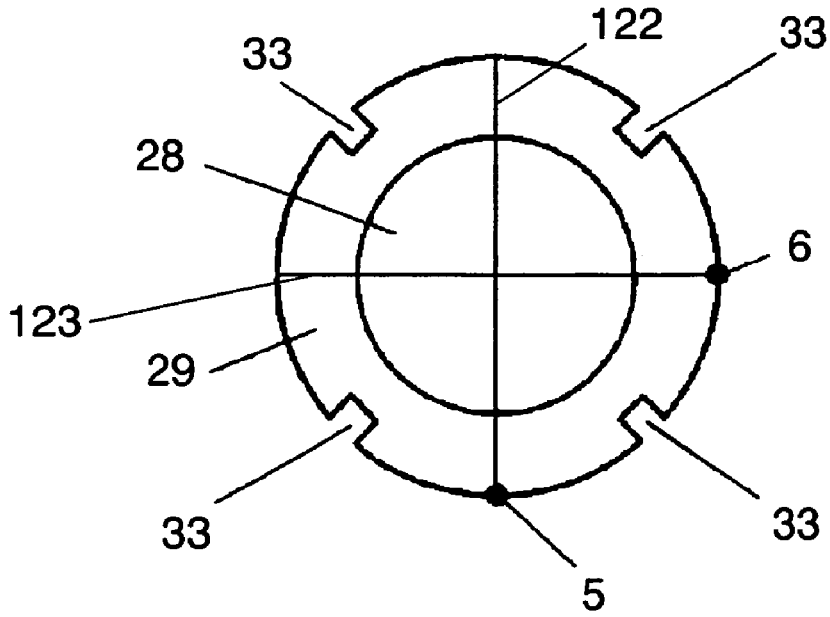

FIG. 8 (*a*) and FIG. 8 (*b*) show an antenna device in accordance with exemplary embodiment 8 of the present invention.

Radiator 1 is formed of crest part 28 and trough part 29 and is faced to ground plate 4 in FIG. 8 (*a*) and FIG. 8 (*b*). The diameter of circular trough part 29 of radiator 1 is a half wavelength in electrical length. Even number of notches 33 are disposed on the periphery of radiator 1.

Notches 33 are disposed symmetrically with respect to straight line 122 passing through feeding point 5 connected to first feeding port 2 and the center point of radiator 1.

Notches 33 are disposed symmetrically also with respect to straight line 123 passing through feeding point 6 connected to second feeding port 3 and the center point of radiator 1. Disposing notches 33 at such positions allows securement of the isolation between first port 2 and second port 3.

Notches 33 in radiator 1 function to equivalently narrow the line-width of the radiator, and hence increase characteristic impedance of the line. Therefore, the diameter of trough part 29 regarded as an effective length of radiator 1 can be shortened, and the antenna device can be downsized.

(Exemplary Embodiment 9)

Figure 9A:
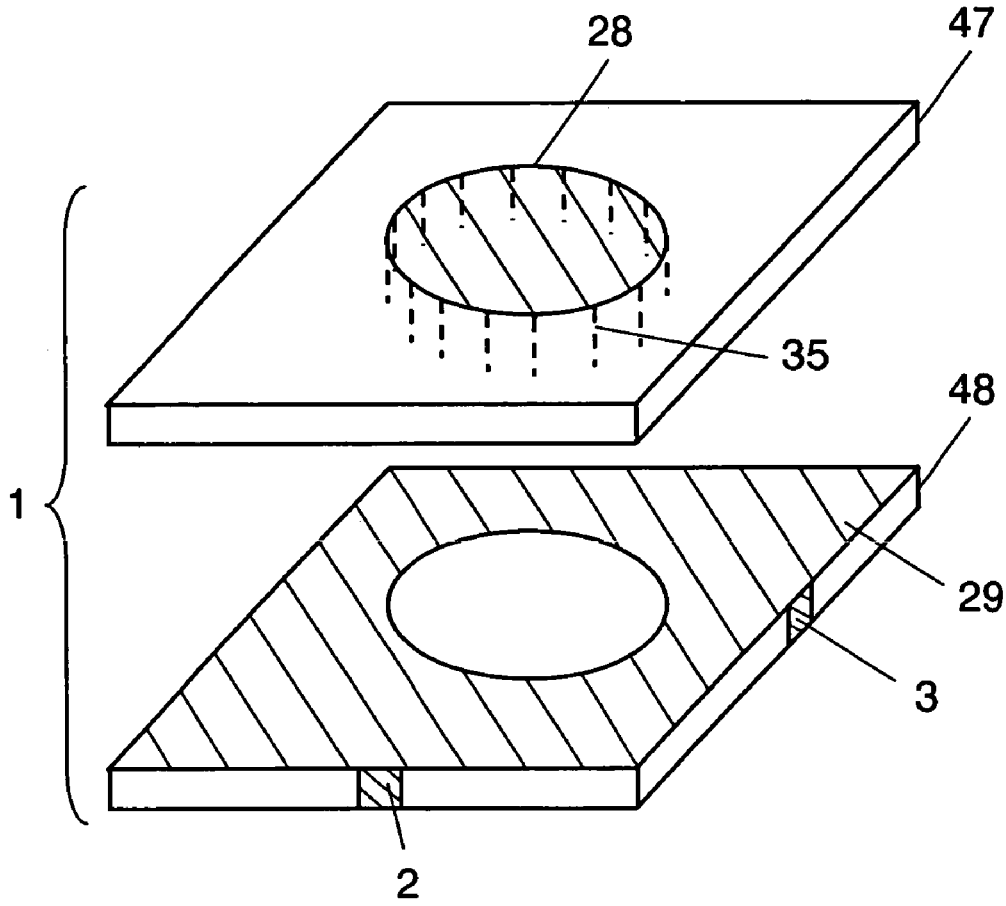
FIG. 9 (*a*) is an exploded perspective view of an antenna device in accordance with exemplary embodiment 9 of the present invention.
Figure 9B:
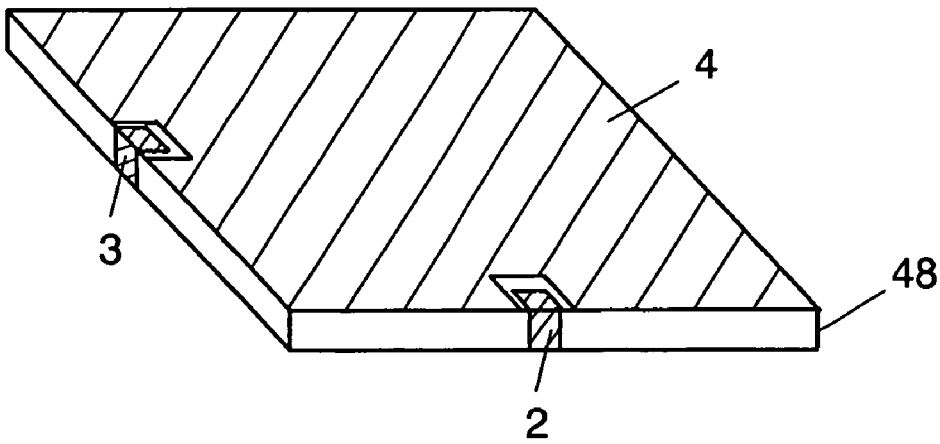
Figure 10A:
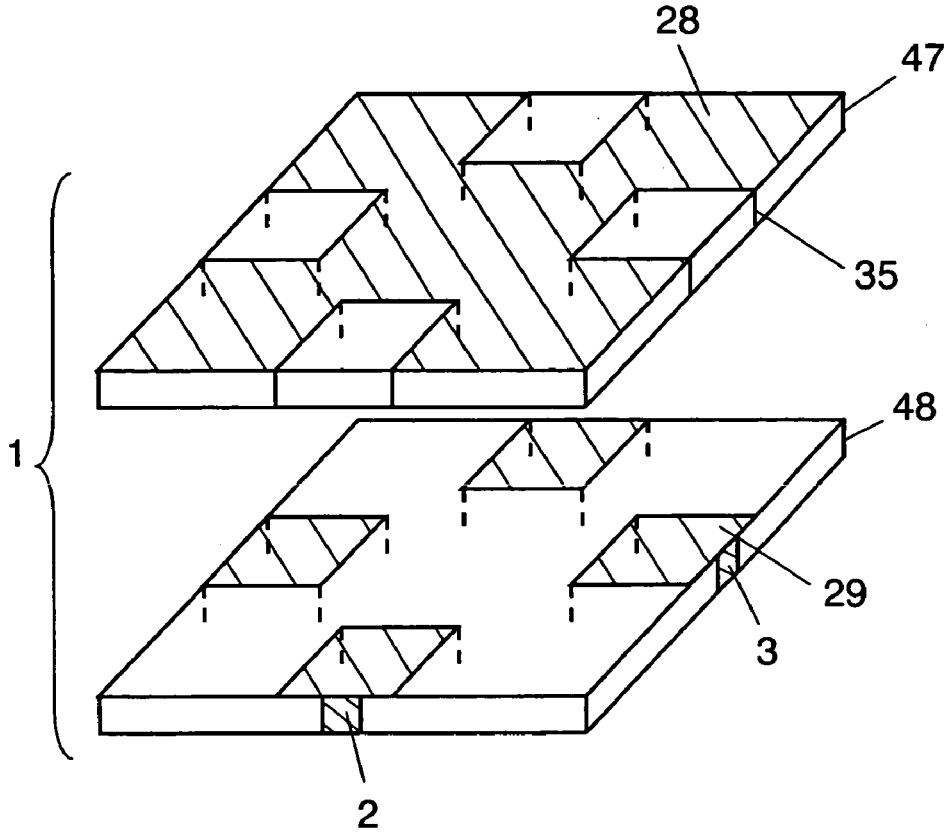
FIG. 10 (*a*) is an exploded perspective view of the antenna device in accordance with exemplary embodiment 9.
Figure 10B:
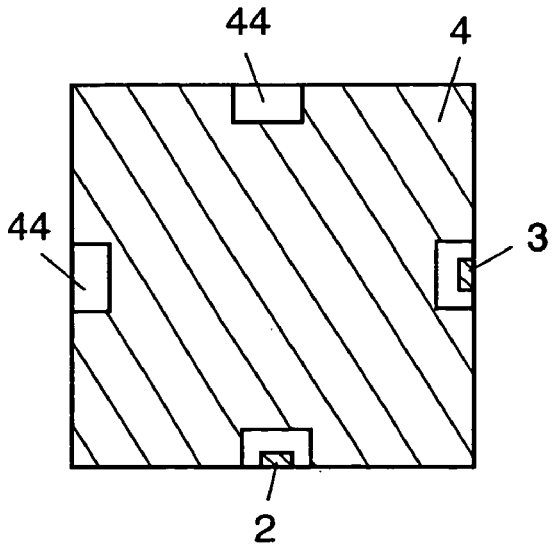

FIG. 9 (*a*), FIG. 9 (*b*), FIG. 10 (*a*), and FIG. 10 (*b*) show antenna devices in accordance with exemplary embodiment 9 of the present invention. The hat-shaped radiator shown in FIG. 6 (*b*) is realized using a laminate of dielectric sheets. In the exploded perspective view of the antenna device of FIG. 9 (*a*), radiator 1 is formed of hat-shaped crest part 28 made of conductive material on a surface of first dielectric sheet 47, via-hole conductors 35 forming the side surface of the crest part, and trough part 29 made of conductive material in a surface of second dielectric sheet 48. Via-hole conductors 35 electrically connect the outer periphery of crest part 28 to the inner periphery of trough part 29. Dielectric sheets 47 and 48 are regularly quadrangular, and have the same edge length equal to a half wavelength in electrical length at a predetermined frequency. Dielectric sheet 47 has crest part 28 made of the conductive material in a region that radially expands from the center of the sheet by ⅛ wavelength or shorter in electrical length. Dielectric sheet 48 has trough part 29 made of the conductive material in a region away from the center of dielectric sheet 48 by ⅛ wavelength or longer in electrical length. First and second feeding ports 2 and 3 made of conductive material are formed on side surfaces of second dielectric sheet 48. Respective line segments connecting the center point of radiator 1 to respective feeding ports 2 and 3 intersect in right angles.

FIG. 9 (*b*) shows the back surface of dielectric sheet 48, and feeding ports 2 and 3 are isolated from ground plate 4.

In the antenna device shown in FIG. 10 (*a*) and FIG. 10 (*b*), similarly, the radiator shown in FIG. 7 (*a*) is realized using a laminate of dielectric sheets 47 and 48. In the exploded perspective view of the antenna device of FIG. 10 (*a*), radiator 1 is formed of crest parts 28 made of conductive material on a surface of first dielectric sheet 47, via-hole conductors 35 forming the side surface of the crest part, and trough parts 29 made of conductive material in a surface of second dielectric sheet 48. Via-hole conductors 35 electrically connect the outer peripheries of crest parts 28 to the inner peripheries of trough parts 29 as shown in FIG. 10 (*a*). First and second feeding ports 2 and 3 made of conductive material are formed on side surfaces of second dielectric sheet 48. Respective line segments connecting the center point of radiator 1 to respective feeding ports 2 and 3 intersect in right angles.

FIG. 10 (*b*) shows the back surface of dielectric sheet 48, and feeding ports 2 and 3 are isolated from ground plate 4. By forming notches 44 so that the shape of ground plate 4 is point-symmetric with respect to the center point, mounting misalignment of the antenna device can be reduced when the antenna device is mounted to a substrate by using a reflow soldering process.

Instead of the dielectric sheets used in the present embodiment, magnetic sheets or sheets made of mixture of dielectric and magnetic materials may be used as an electromagnetic medium.

(Exemplary Embodiment 10)

Figure 11A:
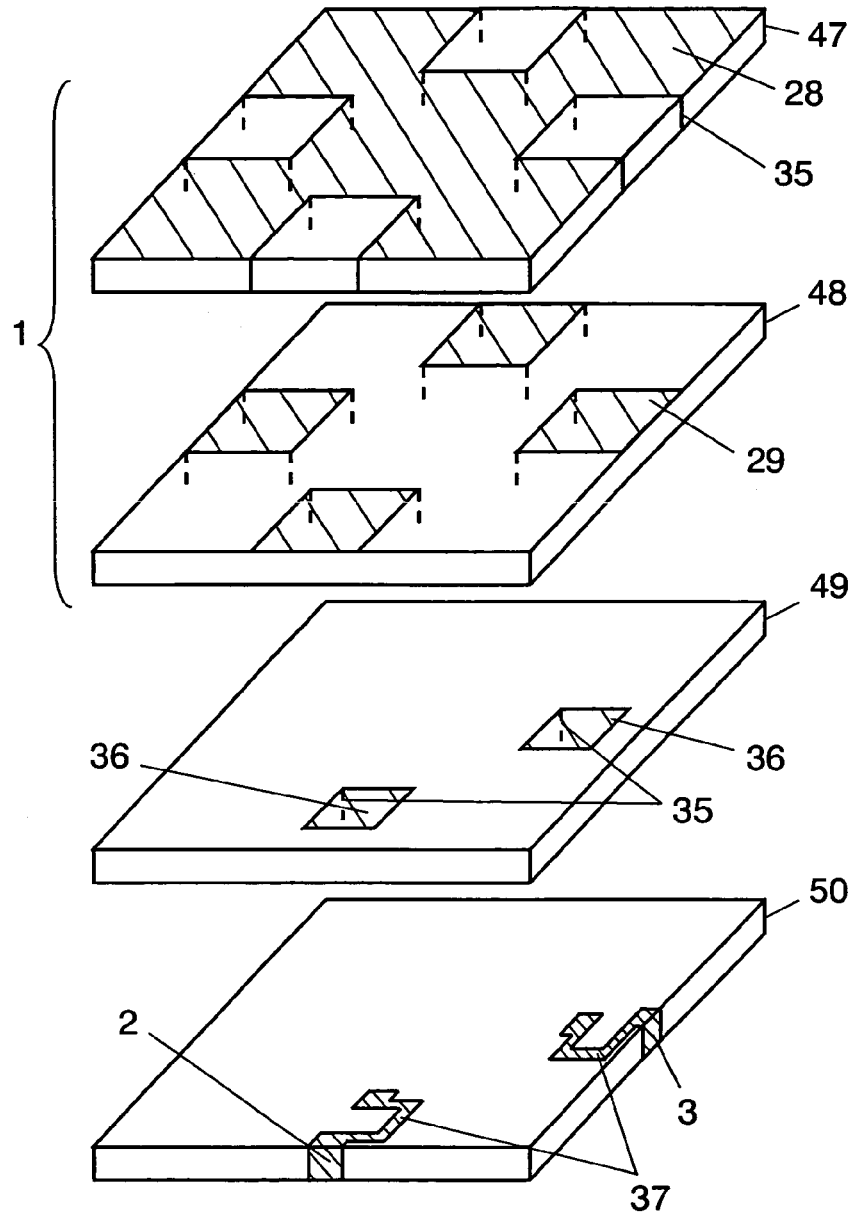
FIG. 11 (*a*) is an exploded perspective view of an antenna device in accordance with exemplary embodiment 10 of the present invention.
Figure 11B:
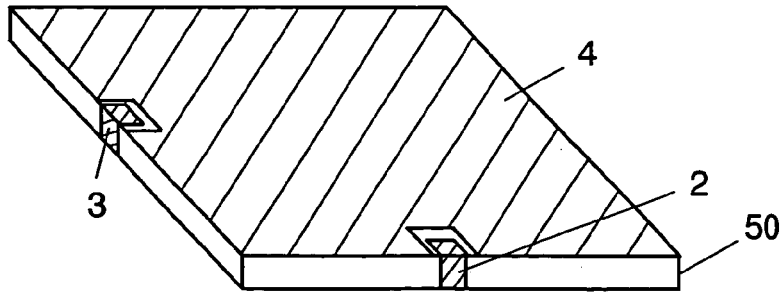

FIG. 11 (*a*) and FIG. 11 (*b*) show an antenna device in accordance with exemplary embodiment 10 of the present invention.

Radiator 1 of the antenna device of the present embodiment is formed of regularly quadrangular electric sheets 47 and 48 whose edge length is a half wavelength in electrical length at a predetermined frequency. In FIG. 11 (*a*), crest part 28 made of the conductive material is formed on the surface of first dielectric sheet 47 except for parts of the periphery thereof. Trough parts 29 made of the conductive material are formed on the surface of second dielectric sheet 48 except for the part corresponding to crest part 28. Via-hole conductors 35 electrically connected to the inside parts of all peripheries of trough parts 29 are formed in electric sheet 47. Owing to such a structure, crest part 28 having a greater interval between ground plate 4 and radiator 1 can be enlarged, and the antenna device having high radiation efficiency and wide-band capability can be realized.

Electrodes 36 for capacitors made of conductive material are disposed on a surface of third dielectric sheet 49, and are faced to trough parts 29, which functions as counter electrodes. Thus, capacitors can be provided in series just under radiator 1. One end of each inductor 37 made of conductive material is electrically connected to each electrode 36 for capacitor through via-hole conductor 35, and the other end of each inductor 37 is connected to each of feeding ports 2 and 3 on a surface of fourth dielectric sheet 50. An impedance-matching circuit can be thus formed by a capacitor and an inductor that are connected in series between each trough part 29 and each of feeding ports 2 and 3, so that the antenna device having a built-in impedance-matching circuit can be realized.

FIG. 11 (*b*) shows the back surface of dielectric sheet 50, and feeding ports 2 and 3 are isolated from ground plate 4. Instead of the impedance-matching circuit used in the present embodiment, an impedance-matching circuit having a circuitry other than a series circuit of a capacitor and an inductor may be employed.

Instead of the dielectric sheets used in the present embodiment, magnetic sheets or sheets made of mixture of dielectric and magnetic materials may be used as an electromagnetic medium.

(Exemplary Embodiment 11)

Figure 12:
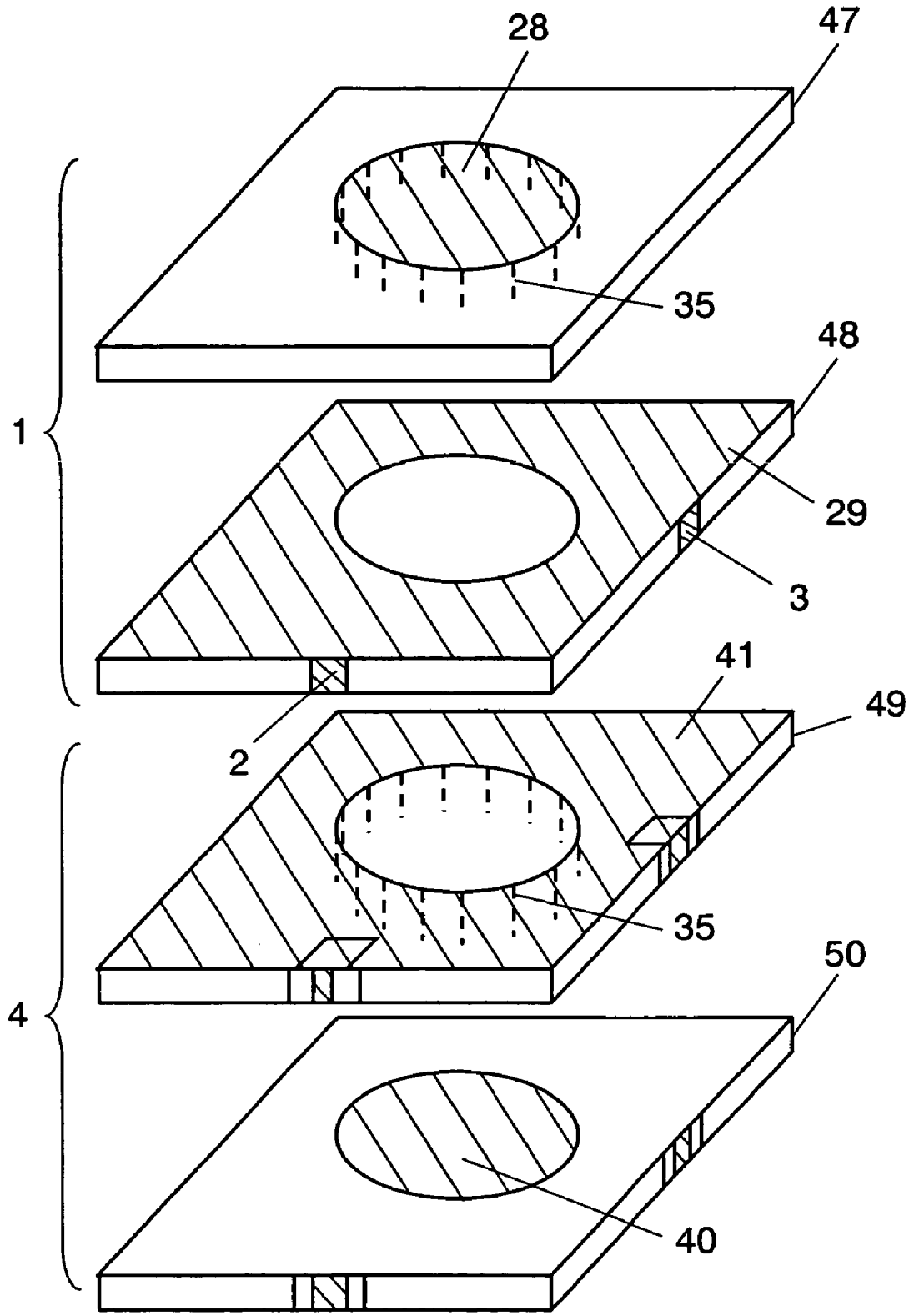
FIG. 12 is an exploded perspective view of an antenna device in accordance with exemplary embodiment 11 of the present invention.

FIG. 12 shows an antenna device in accordance with exemplary embodiment 11 of the present invention. In this embodiment, ground plate 4 of the antenna device shown in FIG. 9 (*a*) and FIG. 9 (*b*) is partially changed in shape, thereby further downsizing the antenna device.

In the exploded perspective view of the antenna device shown in FIG. 12, radiator 1 is formed of hat-shaped crest part 28 made of conductive material on a surface of first dielectric sheet 47, via-hole conductors 35 forming the side surface of the crest part, and hat-shaped trough part 29 made of conductive material in a surface of second dielectric sheet 48. Dielectric sheets 47 and 48 have a regularly quadrangular shape whose edge length is a half wavelength at a predetermined frequency. First dielectric sheet 47 has crest part 28 in a region that radially expands from the center of the sheet by ⅛ wavelength or shorter in electrical length. Second dielectric sheet 48 has trough part 29 in a region away from the center of dielectric sheet 48 by ⅛ wavelength or longer in electrical length.

Ground plate 4 is formed of third dielectric sheet 49 and fourth dielectric sheet 50. Ground plate 4 has hat-shaped trough part 41 made of conductive material in a surface of third dielectric sheet 49, hat-shaped crest part 40 made of conductive material on a surface of fourth dielectric sheet 50, and via-hole conductors 35 that are formed in third dielectric sheet 49 and electrically connects the outer periphery of crest part 40 to the inner periphery of trough part 41. Dielectric sheets 49 and 50 have a regularly quadrangular shape whose edge length is a half wavelength at the predetermined frequency. Crest part 40 of the ground plate lies in a region that radially expands from the center of fourth dielectric sheet 50 by ⅛ wavelength or shorter in electrical length. Trough part 41 of ground plate 4 lies in a region away from the center of the upper surface of third dielectric sheet 49 by ⅛ wavelength or longer in electrical length.

In this way, the interval between mutually facing crest part 28 and crest part 40 can be increased, so that the change of characteristic impedance on the straight line passing through each of feeding ports 2 and 3 and the center point of dielectric sheet 48 is more remarkable than that in embodiment 5, and the antenna device can be further downsized.

Respective line segments passing through the center point of radiator 1 and respective feeding ports 2 and 3 intersect at right angles, and first and second feeding ports 2 and 3 are disposed on the respective line segments.

(Exemplary Embodiment 12)

Figure 13A:
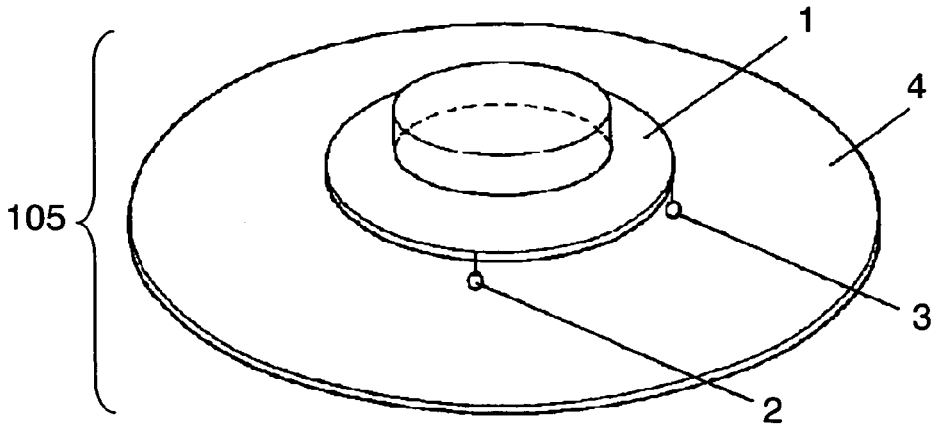
FIG. 13 (*a*) is a perspective view of an antenna device in accordance with exemplary embodiment 12 of the present invention.
Figure 13B:
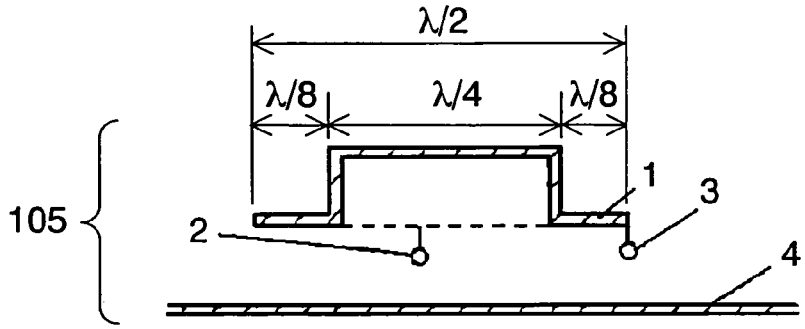

FIG. 13 (*a*) and FIG. 13 (*b*) are a perspective view and a sectional view, respectively, of an antenna device in accordance with exemplary embodiment 12 of the present invention.

In the antenna device of the present embodiment, hat-shaped radiator 1 has a crest part whose diameter is a quarter wavelength in electrical length at a predetermined frequency, and is erected over ground plate 4, as shown in FIG. 13 (*a*) and FIG. 13 (*b*). When an arbitrary point on the outer periphery of radiator 1 is used as a feeding point, from which a predetermined high-frequency signal is input, radiator 1 operates as a half wavelength resonator with both ends opened which is formed on the straight line passing through the feeding point and the center point of radiator 1, similarly to embodiment 5. Radiator 1 has a hat shape and an SIR structure. Therefore, the antenna device can be downsized.

First and second feeding ports 2 and 3 are disposed on the outer periphery of radiator 1, and respective straight lines passing through respective feeding ports 2 and 3 and the center point of radiator 1 intersect at right angles. Disposing feeding ports 2 and 3 in this positional relation can secure the isolation between feeding ports 2 and 3.

That is because the high-frequency voltage generated on radiator 1 is substantially zero on the straight line orthogonal at the center point of radiator 1 to the straight line passing through first feeding port 2 and the center point of radiator 1, when a predetermined high-frequency signal is input through first feeding port 2. The same holds true for second feeding port 3. Therefore, first and second feeding ports 2 and 3 are not affected by each other.

Figure 14:
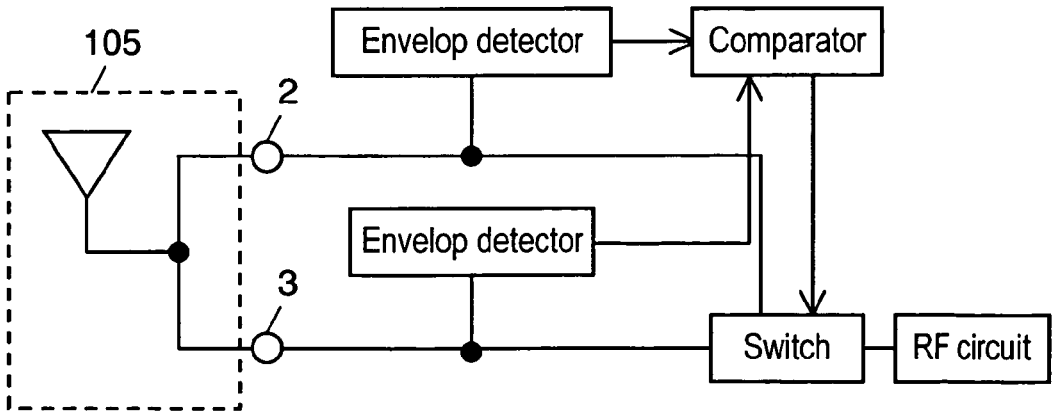
FIG. 14 is a block diagram showing an application of the antenna device in accordance with exemplary embodiment 12.

FIG. 14 shows a block diagram for an application of antenna device 105 in which two mutually independent ports is employed as a diversity antenna device. Received signal levels of first and second feeding ports 2 and 3 are envelope-detected and compared with each other, and the feeding port having higher received signal level is selected by a switch, and then is electrically connected to radio frequency (RF) circuit.

Providing the diversity antenna device with such a structure can reduce the number of required antennas from two to one, so that an inexpensive and small mobile terminal can be realized.

(Exemplary Embodiment 13)

Figure 15:
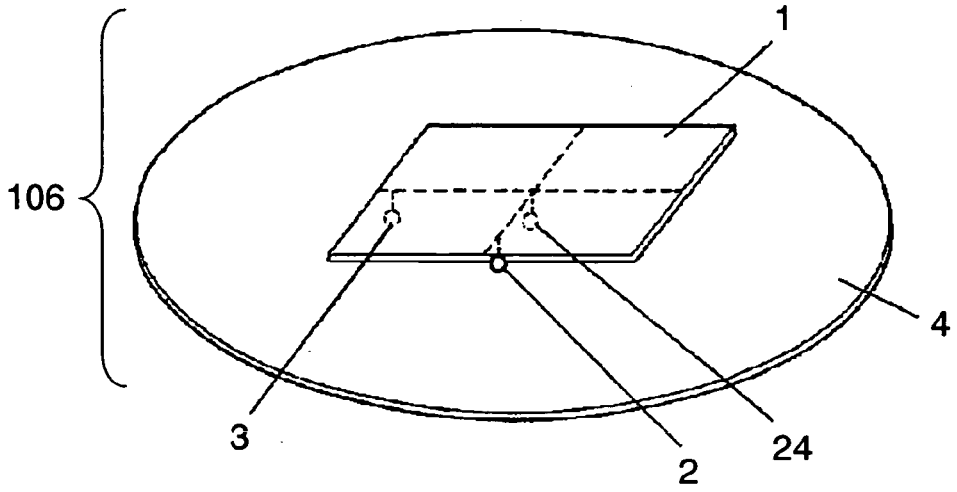
FIG. 15 is a perspective view of an antenna device in accordance with exemplary embodiment 13 of the present invention.
Figure 16:
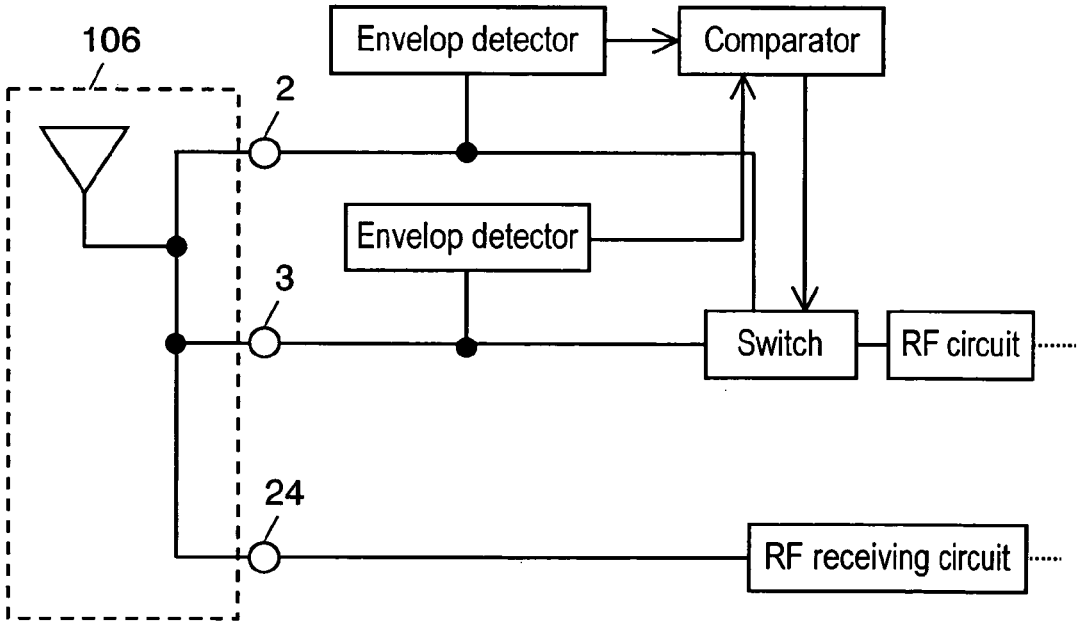
FIG. 16 is a block diagram showing an application of the antenna device in accordance with exemplary embodiment 13.

FIG. 3 (*a*), FIG. 15, and FIG. 16 show an antenna device in accordance with exemplary embodiment 13 of the present invention. FIG. 3 (*a*) and FIG. 15 are a top view and a perspective view of antenna device 106 of embodiment 13, respectively.

Antenna device 106 of the present embodiment has regularly quadrangular radiator 1, whose edge length is a half wavelength at a predetermined frequency, and ground plate 4 facing to radiator 1. In FIG. 3 (*a*) and FIG. 15, first and second feeding ports 2 and 3 are disposed on straight lines that pass through the center point of radiator 1 and are parallel with the edges, thereby securing the isolation between feeding ports 2 and 3.

Antenna device 106 has feeding port 24 for receiving only provided at the center point of radiator 1 as feeding point 27. Here, at the center point of radiator 1, the high-frequency voltages generated on radiator 1 are substantially zero when predetermined high-frequency signals are input through first and second feeding ports 2 and 3.

FIG. 16 shows an example where such an antenna device is employed as an antenna for two communication systems. In this case, first and second feeding ports 2 and 3 of antenna device 106 can be used as feeding ports for a first diversity communication system, and feeding port 24 can be used as a feeding port for receiving only system such as television broadcasting or GPS.

First and second feeding ports 2 and 3 of antenna device 106 may be used as feeding ports of a first communication system employing circular polarization. In this case, feeding port 24 can be also used as a feeding port for receiving only system such as television broadcasting or GPS.

(Exemplary Embodiment 14)

Figure 17:
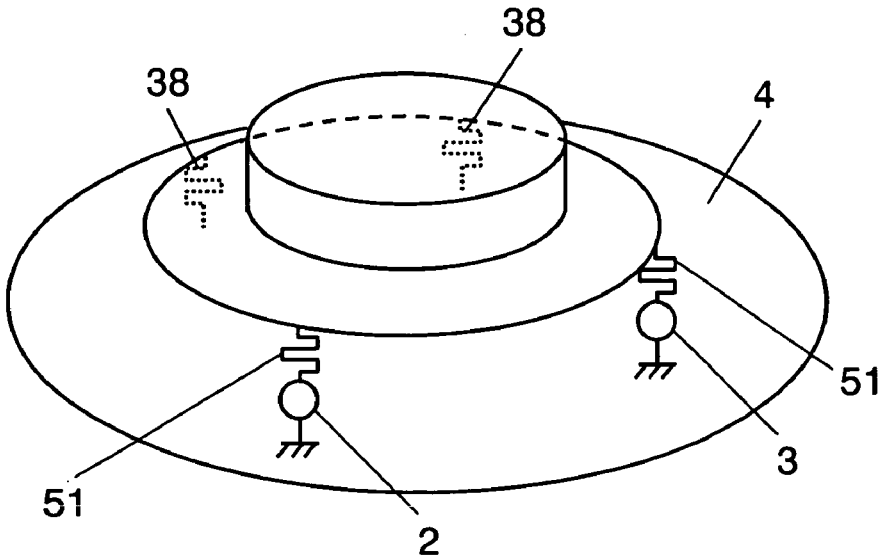
FIG. 17 is a perspective view of an antenna device in accordance with exemplary embodiment 14 of the present invention.

FIG. 17 shows an antenna device in accordance with exemplary embodiment 14 of the present invention.

In FIG. 17, radiator 1 faced to ground plate 4 has a hat shape similarly to embodiment 5. One end of meander-shaped conductive element 38 with both ends opened is connected to a point on the outer periphery of radiator 1 which is in the symmetric position of a feeding point with respect to the center point of radiator 1. Conductive element 51, having the same meander shape, is disposed between each feeding point and each of feeding ports 2 and 3. Electrical length along the straight line passing through the center point of radiator 1 and each of feeding ports 2 and 3 can be designed to be longer by employing such an element, so that resonance frequency of the antenna device can be reduced and the antenna device can be downsized. Additionally, part of the opened ends of meander-shaped conductive element 38 is cut away, thereby adjusting the isolation between the feeding ports and impedance-matching of each feeding port in the antenna device.

The meander-shaped conductive element works as a reactance element.

All conductive elements may have the same shape, all reactance values may be set the same, or all feeding ports may have the same shape. The antenna device thus has a symmetric structure, so that the isolation between the feeding ports can be increased.

(Exemplary Embodiment 15)

Figure 18:
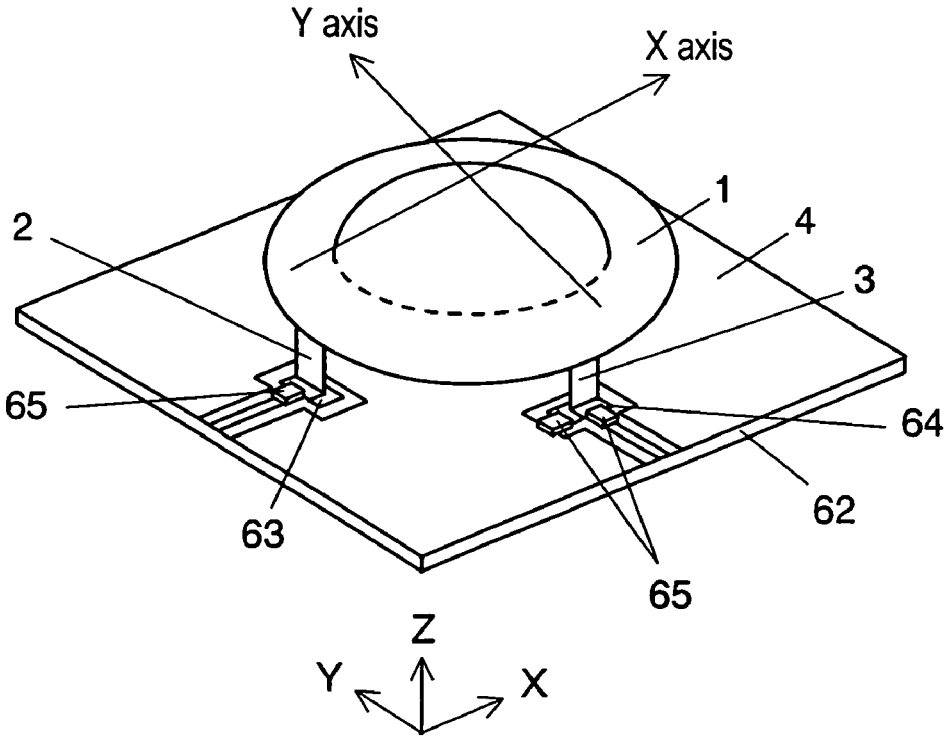
FIG. 18 is a perspective view of an antenna device in accordance with exemplary embodiment 15 of the present invention.
Figure 19:
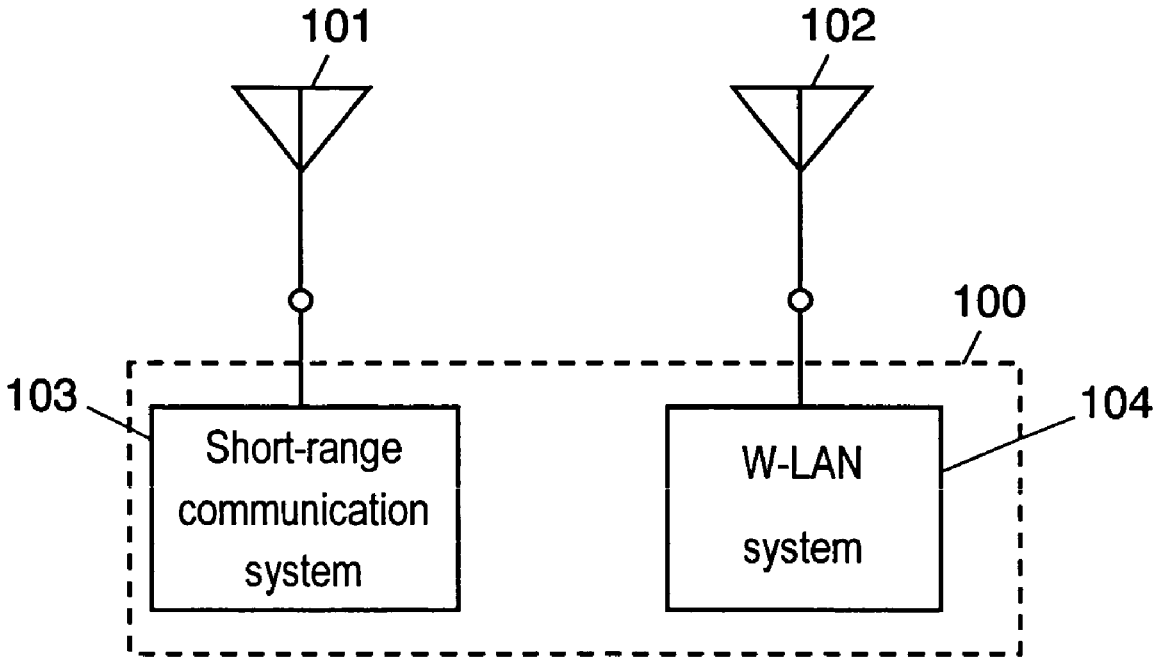
FIG. 19 is a schematic diagram of a conventional antenna device.

FIG. 18 shows an antenna device in accordance with exemplary embodiment 15 of the present invention. In FIG. 18, circular radiator 1 has a diameter of a substantially half wavelength in electrical length, and first and second feeding ports 2 and 3 are disposed on the outer periphery of radiator 1 and on rectangular coordinate axes (X axis and Y axis) set on radiator 1. Feeding ports 2 and 3 are electrically connected to first and second lands 63 and 64 for feeding disposed on high-frequency substrate 62, and connected to respective high-frequency circuits via impedance-matching circuits 65. Ground plate 4 is formed in a large part of the upper surface of high-frequency substrate 62, and the central part of radiator 1 has a dome shape as shown in FIG. 18. The distance between ground plate 4 and the central part of radiator 1 is longer than that between ground plate 4 and the peripheral part of radiator 1. This structure can produce an advantage similar to that in embodiment 5 and allows downsizing of radiator 1.

The antenna device of the present embodiment has feeding ports on the outer periphery of the radiator, so that the antenna device can be manufactured in a simple process including the following steps:

a conductive plate is press-machined; then the central part of radiator 1 is press-molded to be projected in the dome shape; and each one end of the feeding ports is bent substantially perpendicularly to radiator 1. An inexpensive and highly accurate antenna device can be realized.

INDUSTRIAL APPLICABILITY

As described above, the present antenna device can operate as two independent antennas by using a plurality of isolated feeding ports, and hence a diversity antenna or a circular polarization antenna, which requires two separate antennas in a conventional antenna device, can be realized by only a single antenna structure. Thus, the present antenna device can be downsized and made inexpensive.

The invention claimed is:

1. An antenna device for high frequency comprising:

a radiator made of a planar conductor having one of shapes of:

(i) a substantial circle whose diameter is a substantially half wavelength;

(ii) a substantially regular polygon where a length of a diagonal line passing through a center point of the regular polygon is a substantially half wavelength; and (iii) a substantial quadrangle whose edge length is a substantially half wavelength;

a ground plate separated from the radiator by a predetermined distance and disposed in parallel with the radiator;

a first feeding port coupled to a first feeding point on the radiator; and a second feeding port coupled to a second feeding point on the radiator, wherein the first feeding point is disposed in a region where high-frequency voltage generated by feeding from the second feeding port is zero, and the second feeding point is disposed in a region where high-frequency voltage generated by feeding from the first feeding port is zero, and wherein a line segment passing through a center point of the radiator and the first feeding point and a line segment passing through the center point of the radiator and the second feeding point intersect at substantially right angles, and wherein a third feeding port is coupled to a center point of the radiator to isolate the third feeding port from the first and second feeding ports.

2. An antenna device according to claim 1, wherein frequencies of respective high-frequency signals fed from the first, the second, and the third feeding ports are substantially the same.

3. An antenna device according to claim 1, wherein the first and second feeding points are disposed on an outer periphery of the radiator.

4. An antenna device according to claim 1, wherein an electromagnetic medium made of one of a dielectric material, a magnetic material, and a mixture of the dielectric material and the magnetic material is disposed between the radiator and the ground plate.

5. An antenna device according to claim 4, wherein the electromagnetic medium has a multilayered structure, and an impedance-matching circuit is disposed in at least one layer of the multilayered structure, and connected to at least one of the first and the second feeding ports.

6. An antenna device according to claim 1, wherein on the radiator, conductive elements, each having an opened end, are mounted to positions symmetric to the first and the second feeding points with respect to the center point of the radiator.

7. An antenna device according to claim 6, wherein the opened end of each of the conductive elements are cut to change electrical lengths of the conductive elements, so as to adjust a degree of isolation between the first and the second feeding ports.

8. An antenna device according to claim 7, wherein all conductive elements have the same shape.

9. An antenna device according to claim 6, wherein the conductive elements have a meander shape.

10. An antenna device according to claim 6, wherein a reactance element is disposed between the each opened end and the ground plate.

11. An antenna device according to claim 10, wherein all reactance values of the reactance elements are set substantially the same.

12. An antenna device according to claim 6, wherein respective meander-shaped conductive elements are disposed between the first feeding point and the first feeding port and between the second feeding point and the second feeding port.

13. An antenna device according to claim 1, wherein respective meander-shaped conductive elements are disposed between the first feeding point and the first feeding port and between the second feeding point and the second feeding port.

14. An antenna device for high frequency comprising:

a radiator made of a planar conductor having one of shapes of:

(i) a substantial circle whose diameter is a substantially half wavelength;

(ii) a substantially regular polygon where a length of a diagonal line passing through a center point of the regular polygon is a substantially half wavelength; and (iii) a substantial quadrangle whose edge length is a substantially half wavelength;

a around plate separated from the radiator by a predetermined distance and disposed in parallel with the radiator;

a first feeding port coupled to a first feeding point on the radiator; and a second feeding port coupled to a second feeding point on the radiator, wherein the first feeding point is disposed in a region where high-frequency voltage generated by feeding from the second feeding port is zero, and the second feeding point is disposed in a region where high-frequency voltage generated by feeding from the first feeding port is zero, and wherein a line segment passing through a center point of the radiator and the first feeding point and a line segment passing through the center point of the radiator and the second feeding point intersect at substantially right angles, wherein the radiator has a crest part and a trough part, a top surface of the crest part includes the center point and a central part of the radiator, a distance between a top surface of the crest part and the ground plate is longer than a distance between the trough part and the ground plate, and the trough part is a part other than the crest part of the radiator and other than the center point and a central part of the radiator.

15. An antenna device according to claim 14, wherein the top surface of the crest part and the trough part are flat and parallel with the ground plate.

16. An antenna device according to claim 15, wherein a width of the trough part of the radiator is a substantially ⅛ wavelength, and one of a diameter, a diagonal length, and an edge length of the top surface of the crest part is a substantially quarter wavelength.

17. An antenna device according to claim 14, wherein in the outer periphery of the trough part, a plurality of notches are disposed at positions being symmetric with respect to a straight line passing through the first feeding point and the center point of the trough part and a straight line passing through the second feeding point and the center point of the trough part.

18. An antenna device according to claim 14 or claim 17, wherein a width of the trough part of the radiator is a substantially ⅛ wavelength, and one of a diameter, a diagonal length, and an edge length of a top surface of the crest part is a substantially quarter wavelength.

19. An antenna device according to claim 14, wherein the first and second feeding points are disposed on an outer periphery of the radiator.

20. An antenna device for high frequency comprising:

a radiator made of a planar conductor having one of shapes of:

(i) a substantial circle whose diameter is a substantially half wavelength;

(ii) a substantially regular polygon where a length of a diagonal line passing through a center point of the regular polygon is a substantially half wavelength; and (iii) a substantial quadrangle whose edge length is a substantially half wavelength;

a ground plate separated from the radiator by a predetermined distance and disposed in parallel with the radiator;

a first feeding port coupled to a first feeding point on the radiator: and a second feeding port coupled to a second feeding point on the radiator, wherein the first feeding point is disposed in a region where high-frequency voltage generated by feeding from the second feeding port is zero, and the second feeding point is disposed in a region where high-frequency voltage generated by feeding from the first feeding port is zero, and wherein a line segment passing through a center point of the radiator and the first feeding point and a line segment passing through the center point of the radiator and the second feeding point intersect at substantially right angles, and wherein the ground plate has a crest part and a trough part, the ground plate has one of shapes of:

(i) a substantial circle whose diameter is a substantially half wavelength;

(ii) a substantially regular polygon where a length of a diagonal line passing through a center point of the polygon is a substantially half wavelength; and (iii) a substantial quadrangle whose edge length is a substantially half wavelength; and the crest part is formed in such a manner that, a top surface of the crest part includes a center point and a central part of the ground plate, a distance between the top surface of the crest part and the radiator is longer than a distance between the trough part and the radiator, and the trough part is a part other than the crest part and other than the center point and the central part of the around plate.

21. An antenna device according to claim 20, wherein the top surface of the crest part and the trough part in the ground plate are flat and parallel with the radiator.

22. An antenna device according to claim 20, wherein the first and second feeding points are disposed on an outer periphery of the radiator.

23. An antenna device for high frequency comprising:

a radiator made of a planar conductor having one of shapes of:

(i) a substantial circle whose diameter is a substantially half wavelength;

(ii) a substantially regular polygon where a length of a diagonal line passing through a center point is a substantially half wavelength; and (iii) a substantial quadrangle of whose edge length is a substantially half wavelength;

a ground plate which is separated from the radiator by a predetermined distance and is disposed in parallel with the radiator;

a first feeding port coupled to a first, feeding point on the radiator; and a second feeding port coupled to a second feeding point disposed on a line segment orthogonal to a line segment passing through the center of the radiator and the first feeding point, wherein the first and the second feeding ports are used as feeding ports of an antenna in a diversity communication system, wherein a third feeding port is coupled to the center of the radiator, and the first, the second, and the third feeding ports are used as further feeding ports of the antenna in the diversity communication system, wherein the first and the second feeding ports are used as feeding ports of an antenna in a first diversity communication system, and the third feeding port is used in a second communication system.

24. An antenna device for high frequency comprising:

a radiator made of a planar conductor having one of shapes of:

(i) a substantial circle whose diameter is a substantially half wavelength;

(ii) a substantially regular polygon where a length of a diagonal line passing through a center point is a substantially half wavelength; and (iii) a substantial quadrangle of whose edge length is a substantially half wavelength;

a ground plate which is separated from the radiator by a predetermined distance and is disposed in parallel with the radiator;

a first feeding port coupled to a first feeding point on the radiator; and a second feeding port coupled to a second feeding point disposed on a line segment orthogonal to a line segment passing through the center of the radiator and the first feeding point, wherein the first and the second feeding ports are used as feeding ports of an antenna in a diversity communication system;

wherein a third feeding port is coupled to the center of the radiator, and the first, the second, and the third feeding ports are used as further feeding ports of the antenna in the diversity communication system, wherein the first and the second feeding ports are used as feeding ports of a circular polarization antenna in a first diversity communication system employing circular polarization, and the third feeding port is used in a second communication system.

25. An antenna device for high frequency comprising:

a radiator made of a conductor having a conical shape, a diameter of the conical shape being a substantially half wavelength;

a ground plate separated from the radiator by a predetermined distance and disposed in parallel with the radiator;

a first feeding port coupled to a first feeding point on the radiator; and a second feeding port coupled to a second feeding point on the radiator, wherein a distance between the ground plate and the radiator is longer at an apex thereof than at other parts thereof than the apex, the first feeding point is disposed in a region where high-frequency voltage generated by feeding from the second feeding port is zero, and the second feeding point is disposed in a region where high-frequency voltage generated by feeding from the first feeding port is zero, and wherein a line segment passing through a center point of the radiator and the first feeding point and a line segment passing through the center point of the radiator and the second feeding point intersect at substantially right angles.

* * * * *

UNITED STATES PATENT AND TRADEMARK OFFICE

CERTIFICATE OF CORRECTION

PATENT NO. : 7,057,558 B2
APPLICATION NO. : 10/490373
DATED : June 6, 2006
INVENTOR(S) : Susumu Fukushima et al.

It is certified that error appears in the above-identified patent and that said Letters Patent is hereby corrected as shown below:

Title Page line 1,
At (56) References Cited, U.S. PATENT DOCUMENTS, enter
-- 4,538,153.....8/1985.....Taga --.

Title Page line 9,
At (56) References Cited, FOREIGN PATENT DOCUMENTS, enter
-- JP 10-247818.....9/1998 --.

Column 14
Line 8, between "1" and ", wherein", insert -- or claim 7 --.
Line 19, between "1" and ", wherein", insert -- or claim 7 --.
Line 60, "around" should read -- ground --.

Column 16
Line 53, between "first" and "feeding", delete the comma ",".

Signed and Sealed this

Thirtieth Day of January, 2007

JON W. DUDAS
*Director of the United States Patent and Trademark Office*